US011390092B2

(12) United States Patent
Milini

(10) Patent No.: US 11,390,092 B2
(45) **Date of Patent: *Jul. 19, 2022**

(54) DIGITAL PRINTING SYSTEM FOR PRINTING ON FABRIC INCLUDING FOAM PRETREATMENT

(71) Applicant: MS Printing Solutions S.R.L., Caronno Pertusella (IT)

(72) Inventor: Luigi Milini, Saronno (IT)

(73) Assignee: Dover Europe Sàrl, Vernier (CH)

( * ) Notice: Subject to any disclaimer, the term of this patent is extended or adjusted under 35 U.S.C. 154(b) by 168 days.

This patent is subject to a terminal disclaimer.

(21) Appl. No.: 16/320,324

(22) PCT Filed: Jul. 25, 2017

(86) PCT No.: PCT/IB2017/054510
§ 371 (c)(1),
(2) Date: Jan. 24, 2019

(87) PCT Pub. No.: WO2018/020420
PCT Pub. Date: Feb. 1, 2018

(65) Prior Publication Data

US 2019/0275808 A1 Sep. 12, 2019

(30) Foreign Application Priority Data

Jul. 27, 2016 (IT) ..... 102016000078681

(51) Int. Cl.
*B41J 3/407* (2006.01)
*B41J 11/00* (2006.01)
(Continued)

(52) U.S. Cl.
CPC ..... *B41J 3/4078* (2013.01); *B41J 2/155* (2013.01); *B41J 2/2114* (2013.01);
(Continued)

(58) Field of Classification Search
None
See application file for complete search history.

(56) References Cited

U.S. PATENT DOCUMENTS 3,348,989 A 10/1967 Roberts
4,106,896 A 8/1978 Norris et al.
(Continued)

FOREIGN PATENT DOCUMENTS

CN 1326715 A 12/2001
CN 1662309 A 8/2005
(Continued)

OTHER PUBLICATIONS

PCT International Search Report and Written Opinion in International Application No. PCT/IB2017/054510, dated Oct. 10, 2017, 10 pages.

(Continued)

*Primary Examiner* — Leslie J Evanisko
(74) *Attorney, Agent, or Firm* — Fish & Richardson P.C.

(57) ABSTRACT

The present invention refers to a plant (1) for printing a fibrous material (T). The printing plant (1) comprises: a station (14) for supplying a fibrous material configured for supplying the fibrous material along a predetermined operative path, a treating station (10) configured for treating the fibrous material with a treatment composition by applying the composition itself on a first side (T1) of the fibrous material (T); and a printing station (6) configured for ink-printing at least part of a second side (T2) of the fibrous material (T) opposite to the first side (T1). Moreover, the present invention refers to a process of printing a fibrous material.

20 Claims, 7 Drawing Sheets

(51) Int. Cl.

| | |
|---|---|
| ***B41J 15/04*** | (2006.01) |
| ***D06B 21/00*** | (2006.01) |
| ***B41J 11/42*** | (2006.01) |
| ***B41J 2/155*** | (2006.01) |
| ***B41J 15/16*** | (2006.01) |
| ***B41J 15/06*** | (2006.01) |
| ***B41J 2/21*** | (2006.01) |
| *B41M 5/00* | (2006.01) |
| *B41F 31/28* | (2006.01) |

(52) U.S. Cl.

CPC ..... *B41J 11/0015* (2013.01); *B41J 11/0095* (2013.01); *B41J 11/42* (2013.01); *B41J 15/048* (2013.01); *B41J 15/06* (2013.01); *B41J 15/165* (2013.01); *D06B 21/00* (2013.01); *B41F 31/28* (2013.01); *B41J 11/00216* (2021.01); *B41M 5/0011* (2013.01); *B41M 5/0047* (2013.01); *B41M 5/0064* (2013.01)

(56) References Cited

U.S. PATENT DOCUMENTS

| | | | | |
|---|---|---|---|---|
| 4,193,762 | A | 3/1980 | Namboodri | |
| 4,403,359 | A | 9/1983 | Kutz | |
| 4,448,581 | A | 5/1984 | Fennekels et al. | |
| 4,463,467 | A | 8/1984 | Gruber et al. | |
| 5,165,261 | A | 11/1992 | Cho | |
| 5,902,753 | A | 5/1999 | DeMott et al. | |
| 8,393,698 | B2 | 3/2013 | Ichimura et al. | |
| 8,398,225 | B2 | 3/2013 | Ichimura et al. | |
| 8,540,337 | B2 | 9/2013 | Imoto et al. | |
| 2005/0206711 | A1 | 9/2005 | Milini | |
| 2005/0212835 | A1 | 9/2005 | Konno | |
| 2006/0210719 | A1* | 9/2006 | Smith | D06P 5/30 427/428.01 |
| 2009/0151625 | A1* | 6/2009 | Matsumoto | B41J 2/2114 118/100 |
| 2009/0165937 | A1 | 7/2009 | Inoue et al. | |
| 2013/0293617 | A1 | 11/2013 | Suzuki et al. | |
| 2014/0043393 | A1* | 2/2014 | Takeuchi | B41J 2/07 347/21 |
| 2015/0054885 | A1* | 2/2015 | Sugiyama | D06P 1/5292 347/21 |
| 2015/0239264 | A1* | 8/2015 | Ishizuka | D06P 5/30 347/102 |

FOREIGN PATENT DOCUMENTS

| | | | | |
|---|---|---|---|---|
| CN | 101765500 | | 6/2010 | |
| CN | 101852880 | A | 10/2010 | |
| CN | 103276608 | | 9/2013 | |
| CN | 104859303 | A | 8/2015 | |
| DE | 3109373 | | 9/1982 | |
| DE | 102012101872 | | 9/2012 | |
| EP | 0158736 | | 5/1988 | |
| EP | 0663300 | | 10/2001 | |
| EP | 1577101 | | 9/2005 | |
| EP | 2643159 | | 10/2013 | |
| EP | 2910381 | | 8/2015 | |
| EP | 3268229 | | 1/2018 | |
| EP | 3386765 | | 10/2018 | |
| EP | 3044363 | | 11/2019 | |
| GB | 2466067 | | 6/2010 | |
| IT | CO20130034 | | 1/2015 | |
| JP | 2012197531 | | 10/2012 | |
| JP | 2013023771 | | 2/2013 | |
| JP | 2014065289 | A * | 4/2014 | |
| WO | WO-0218703 | A1 * | 3/2002 | D06P 5/30 |
| WO | WO 2009035137 | | 3/2009 | |
| WO | WO 2009142252 | | 11/2009 | |
| WO | WO 2015035323 | | 3/2015 | |

OTHER PUBLICATIONS

CN Office Action in Chinese Appln. No. 201780059837.5, dated Apr. 15, 2020, 32 pages (with English translation).

CN Office Action in Chinese Appln. No. 201780059837.5, dated Apr. 1, 2021, 21 pages (with English Translation).

CN Office Action in Chinese Appln. No. 201780059837.5, dated Nov. 5, 2020, 27 pages (with English translation).

EP Office Action in European Appln. No. 17755568.7, dated Nov. 17, 2021, 5 pages.

Shen et al., "A foam single-face pretreatment to modify silk fabric using EBODAC to improve inkjet printing performance," The Journal of the Textile Institute, 2014, 105(8):799-805.

* cited by examiner

DIGITAL PRINTING SYSTEM FOR PRINTING ON FABRIC INCLUDING FOAM PRETREATMENT

CROSS-REFERENCE TO RELATED APPLICATIONS

This application is a U.S. National Stage Entry under 35 USC § 371 of International Patent Application No. PCT/IB2017/054510, filed on Jul. 25, 2017, which claims the benefit of Italian Patent Application No. 102016000078681, filed on Jul. 27, 2016, both of which are hereby incorporated by reference in their entirety.

FIELD OF THE INVENTION

The present invention refers to a printing plant, particularly for digitally printing, a fibrous material having a shape as a discrete sheet or as a web; the invention moreover refers to a process of printing, particularly of digitally printing, said fibrous material as a discrete sheet or web. The plant and the respective process object of the invention can find an application in the field for printing fabrics and/or non-woven fabrics. The invention is generally, but in a non-limiting way, applicable in the textile or knitted fabrics or non-woven fabric industry.

STATE OF THE ART

As it is known, the conventional printing—in other words the one using printing silk-screen cylinders or frames—and the digital-type printing—in other words the one using one or more printing nozzle heads—are technologies used for applying inks or paints defining motives, patterns, colorations on sheet materials of several types, such as for example, paper, fabrics, non-woven fabrics, fell and more.

The fabrics, non-woven fabrics, or other fibrous materials having a laminar structure destined both to the conventional and digital printing, are subjected to a number of preparation steps, before the printing step, and to one or more steps of finishing the fabric, after the printing step. A suitable pre-treatment at least for the surface of the fibrous material, before the printing process, ensures to deposit the ink in the desired way and position, and to suitably fix it to the fibrous material itself.

As an example, the fibrous material to be printed can be treated by substances adapted to enable a suitable definition of the printed pattern on the fibrous material and to correctly fix the printing colors on the material itself: these treatments are for example performed by means of alkali-based or acid-based substances (according to the type of ink subsequently applied), thickener-based, anti-migration-based substances and/or moisture givers. These substances and the associated pre-treatment processes are known and used in the textile field and—generally—change as a function of the fabric and type of printing ink. The pre-treatment enables the ink drops to be fixed to the fibers of the material to be printed without forming marks and without spreading around in an uncontrolled way: the preliminary step of treating the fabric therefore ensures a good color yield and a suitable definition. Particularly, in the digital printing processes, a suitable pre-treatment of the material to be printed, has a crucial importance. Actually, in the digital printing, jet heads having a plurality of nozzles having a small ink passage opening are used: in this situation, it is virtually impossible to directly add the ink because this latter could become, for example, too much viscous, which would prevent the ink from regularly passing through the heads, or could get chemical-physical characteristics which are not easily manageable by the systems controlling the same digital heads. Due to this reason, the material to be printed is previously treated and, only after, is subjected to the digital printing.

Now, it is known a pre-treatment step providing the application of a liquid solution containing both anti-migration agents (preventing the dispersion of the printing ink) and agents adapted to enable to fix the printing color on the fibrous material. This pre-treatment substances are typically applied by dipping the fibrous material in suitable tanks: this technique inevitably leaves the material to be printed wet. Therefore, for enabling to print pre-treated fibrous materials, now it is provided a step of drying the material before the printing step and after the step of applying additives. See, for example, the pre-treatment and digital printing apparatus for sheet materials, described in the patent application WO2012069242. Such apparatus is provided with a station for unwinding the fibrous material, which is adapted to supply an impregnating station (pre-treating station). The impregnating station consists of a tank receiving a liquid solution of fixing agents configured for enabling to fix the printing color on the fibrous material. The fibrous material is introduced in the tank so that the same can be completely dipped in the liquid solution (fixing agents). The material, exiting the impregnating tank, is constrained to pass through squeezing rolls configured for removing part of the fixing solution from the fibrous material. Then, the fibrous material is positioned on a conveyor belt and is printed. The printed fibrous material, exiting the conveyor belt, is delivered to a color-fixing station which provides to hit the material by hot air or a hot stream. The printed and fixed fibrous material, exiting the fixing station, is lastly wound on a roll.

A further known way of pre-treating and digitally printing a sheet material (fabrics included) is described in the patent EP1577101B1 (and in the associated patent application US 2005-206711A1) disclosing an apparatus provided with a closed-loop movable conveyor belt on which the sheet material to be printed can be fixed. Particularly, the sheet material is constrained to the conveyor belt along a portion of the closed loop defining an operative length. The apparatus exhibits a pre-treatment substance applicator, a pre-treated material drier and a printing device active at the operative length: such elements operate on the sheet material engaged on the conveyor belt.

Although the above cited apparatuses enable to pre-treat and print sheet fibrous materials, the Applicant has discovered that such apparatuses are however not devoid of some shortcomings and therefore are improvable under different aspects.

De facto, the nowadays known apparatuses comprise an impregnating step which considerably wets the fibrous material so that the material itself, at the end of the impregnating step, cannot be immediately printed or can be printed with a reduced and insufficient printing resolution.

OBJECT OF THE INVENTION

Therefore, it is an object of the present invention to substantially solve at least one of the shortcomings and/or limitations of the previous solutions.

A first object of the invention consists of providing a plant and an associated printing process enabling an efficient treatment of fibrous materials as discrete sheet or web, for example fabrics, knitted fabrics and/or non-woven fabrics, in order to place the sheet material under optimal conditions for being printed, particularly for being digitally printed.

Specifically, it is an object of the invention to provide a plant enabling a controlled and efficient step of treating the sheet material as discrete sheet or continuous web wherein the same is wetted and/or impregnated with pre-treatment substances—for example thickening and/or anti-migration additives—for appropriately preparing the fibrous material for the printing.

An object of the present invention consists of providing a plant for digitally printing a fibrous material as discrete sheet or continuous web, which enables dedicated printing heads to operate at a reduced distance from the fibrous material in order to ensure high printing resolutions.

A further object of the invention consists of providing a plant and an associated process of printing fibrous materials as discrete sheet or continuous web, which enable to quickly treat the material itself; particularly it is an object of the present invention to provide a plant enabling to minimize the treatment time of the fibrous material as discrete sheet or continuous web, in order to reduce to the smallest possible amount the time and cost of the printing process.

Then, it is an object of the invention to provide a printing plant and process which can be implemented with reasonable running costs and offering a high productivity, by minimizing the quantity of the used pre-treatment substances for the sake of the environment.

One or more of the above described objects which will better appear during the following description, are substantially met by a plant and process of printing fibrous materials as discrete sheet or continuous web according to anyone of the attached claims and/or according to one or more of the following aspects.

SUMMARY

The aspects of the invention are described in the following. In a 1st aspect it is provided a plant (1), particularly for digitally printing, a fibrous material as a discrete sheet or continuous web (T), said plant (1) comprising:

at least one treating station (4) configured for treating the fibrous material as a discrete sheet or continuous web with a treatment composition by applying the composition itself on a first side (T1) of the fibrous material as discrete sheet or continuous web (T); and at least one printing station (6) configured for ink-printing, particularly by digital print, at least part of a second side (T2) of the fibrous material as discrete sheet or continuous web (T) opposite to the first side (T1).

In a 2nd aspect according to the aspect 1, the plant (1) comprises at least one station (14) for supplying the fibrous material (T) to be printed, the supplying station (14) being configured for supplying the fibrous material (T) to be printed along a predetermined operative path.

In a 3rd aspect according to the aspect 1 or 2, the treating station (4) comprises at least one applicator (12) of a treatment composition operating below the sheet fibrous material (T) supplied along said predetermined operative path.

In a 4th aspect according to anyone of the preceding aspects, the plant (1) comprises at least one conveyor belt (2) exhibiting an exposed surface (S) configured for receiving the fibrous material (T), the exposed surface exhibiting constantly an operative path (3) configured for temporarily contactingly receiving the first side (T1) of the fibrous material (T), optionally from the supplying station (14), and for guiding such fibrous material along an advancement direction (A).

In a 5th aspect according to the aspect 4, the exposed surface (S) of the conveyor belt (2) comprises constantly a depositing section (3*a*) extending upstream the operative section (3) of the conveyor belt itself with respect to the advancement direction (A), said applicator (12) being positioned and configured for disposing the treatment composition on the exposed surface of the depositing section (3*a*) of the conveyor belt.

In a 6th aspect according to the aspect 5, the conveyor belt is configured for transporting the treatment composition applied on the depositing section (3*a*) to an initial contact area wherein the conveyor belt is estimated to start to come in contact with the sheet fibrous material (T), particularly supplied along the advancement direction and optionally along said operative path.

In a 7th aspect according to the aspect 6, the plant comprises at least one pressure organ (5*a*), optionally comprising at least one pressure cylinder operating above the exposed surface of the conveyor belt at said initial contact area, the pressure organ (5*a*) being configured for acting under pressure on the fibrous material, particularly supplied along the operative path, by thrusting said fibrous material against the exposed surface (S) of the conveyor belt for promoting a continuous adhesion.

In an 8th aspect according to the preceding aspect, the plant (1) comprises at least one anvil pressure organ (5*b*), optionally comprising at least one anvil pressure cylinder, operating below the exposed surface (S) of the conveyor belt at said initial contact area, the anvil pressure organ (5*b*) being in a position opposite to the pressure organ (5*a*) with respect to the conveyor belt (2) and being configured for supportingly acting on the conveyor belt in opposition to the pressure organ.

In a 9th aspect according to anyone of the preceding aspects, the treatment composition—supplied from the treating station (4)—comprises at least one treatment foam comprising at least one of:

an anti-migration agent, a pH control agent, a hydrotropic agent.

In a 10th aspect according to the preceding aspect, the treatment foam comprises at least one treatment liquid in a quantity comprised between 5% and 75% by weight with respect to the total weight of the foam, said treatment liquid comprising:

at least one anti-migration agent, preferably selected among alginates, derivatives of the cellulose, particularly carboximethylcellulose, hydroxyethylcellulose, acrylic (co)polymers, xanthan gum, Arabic gum, and guar gum, and/or a fixing agent, particularly said fixing agent comprises at least one of:

at least one pH control agent, preferably selected among: sodium bicarbonate, sodium carbonate, ammonium sulfate, ammonium tartrate, and citric acid, and at least one hydrotropic agent, preferably selected between urea and thiourea, at least one foaming agent in a weight percentage comprised between 0.2% and 5%, preferably between 0.4% and 2%, with respect to the total weight of the foam, water in a quantity needed to reach 100%.

In an 11th aspect according to the aspect 9 or 10, when these latter depend on anyone of the aspects from 3 to 8, wherein the plant comprises:

at least one foam sensor (11) configured for emitting a control signal representative of the foam quantity placed immediately upstream the initial contact area, a control unit (9) connected to the foam sensor and configured for receiving said control signal and controlling said applicator based on said control signal.

In a 12th aspect according to the preceding aspect, the foam sensor (11) is configured for generating said control signal which contains at least one characteristic related to a size of said foam accumulation in a predetermined control plane, said control unit being configured for:

receiving said control signal, determining, as a function of said control signal, a measured value of the size of said foam accumulation, comparing said measured value with at least one reference value or range, controlling said applicator based on a difference between said measured value and said reference value or range of said accumulation.

In a 13th aspect according to the aspect 11 or 12, the foam sensor (11) comprises:

an emitter (11*a*) of a primary signal configured for emitting said primary signal towards said initial contact area;

a receiver (11*b*) of a secondary signal, returning from said foam accumulation possibly present upstream said contact area, responsive to said primary signal, based on the secondary signal, said receiver being configured for generating said control signal which exhibits said at least one characteristic related to the size of said foam accumulation in a predetermined control plane, said primary signal being an electric, electromagnetic or acoustic signal, said secondary signal being an electric, electromagnetic or acoustic signal; or wherein the foam sensor comprises:

a first presence sensor (11*c*) placed and configured for determining the presence of an foam accumulation upstream said contact area having a size along a predetermined direction greater than a minimum value, and a second presence sensor (11*d*) distanced form the first present sensor placed and configured for determining the presence of an accumulation of foam upstream said contact area having a size along a predetermined direction greater than a maximum value.

In a 14th aspect according to the aspect 11 or 12 or 13, the control unit is configured for:

commanding said applicator to increase a deposition flow rate of said foam on the belt if the measured value of the size of said foam accumulation is less than a reference value or range, and commanding said applicator to reduce the deposition flow rate of the foam on the belt if the measured value of the size of said foam accumulation is greater than the reference value or range.

In a 15th aspect according to anyone of the aspects from 4 to 14, the plant comprises:

at least one movement sensor connected to the conveyor belt (2) and configured for emitting a monitoring signal representative of a movement speed of the conveyor belt along the advancement direction (A), a control unit connected to the movement sensor and configured for receiving said monitoring signal and controlling said applicator based on said monitoring signal.

In a 16th aspect according to the preceding aspect, the control unit (9) is configured for:

receiving said monitoring signal, determining, based on said monitoring signal, a measured value of the movement speed of the conveyor belt (2) along the advancement direction (A), controlling said applicator based on the measured value of the movement speed of the conveyor belt.

In a 17th aspect according to the aspect 15 or 16, the monitoring sensor comprises an encoder.

In an 18th aspect according to anyone of the aspects from 15 to 17, the control unit is configured for:

commanding the applicator (12) to increase a deposition flow rate of the treatment composition if the measured value of the movement speed of the conveyor belt (2) is less than a reference value or range, and commanding the applicator (12) to reduce the deposition flow rate of the treatment composition if the measured value of the movement speed of the conveyor belt (2) is greater than the reference value or range.

In a 19th aspect according to anyone of the aspects from 4 to 18, the conveyor belt (2) exhibits the exposed surface (S) thereof, treated with a non-water-soluble adhesive material, particularly exhibits the exposed surface treated with an adhesive material comprising a polymeric glue sensitive to at least one between pressure and temperature.

In a 20th aspect according to anyone of the aspects from 4 to 19, the printing station (6) operates at the conveyor belt (2) and is configured for printing on the second side (T2) of the fibrous material (T) placed on the operative section (3) of the conveyor belt (2).

In a 21st aspect according to anyone of the aspects from 4 to 20 comprising a drying station (16) operating at the conveyor belt (2), upstream the printing station and configured for drying at least part of the second side (T2) of the fibrous material (T) placed on the operative section (3) of the conveyor belt (2).

In a 22nd aspect according to the preceding aspect wherein the drying station comprises at least one selected in the group among:

at least one irradiation lamp, particularly at least one infrared lamp, facing the second side (T2) of the fibrous material (T), at least one blowing system configured for generating an air flow at the fibrous material, particularly at the second side (T2) of the sheet fibrous material (T).

In a 23rd aspect according to the aspect 21 or 22, the plant comprises at least one drying station (16) interposed between the pressure organ (5*b*) and the printing station (6).

In a 24th aspect according to anyone of the aspects from 9 to 23 when these latter depend on anyone of the aspects from 3 to 8, wherein the applicator (12) is configured for applying on the exposed surface of the conveyor belt, a treatment foam exhibiting, immediately downstream the applicator, a thickness less than 5 mm, particularly comprised between 0.5 and 3 mm.

In a 25th aspect according to anyone of the aspects from 11 to 24, the control unit is connected to the applicator (12) and is configured for adjusting said thickness of the treatment foam as a function of said difference between said measured value and said reference value or range.

In a 26th aspect according to anyone of the aspects from 3 to 25, the applicator (12) comprises at least one among:

a coating blade placed transversally to the motion of the conveyor belt and movable above the depositing section, a spray dispenser movable above the operative section, an applicator roll with an associated respective blade for adjusting the thickness of the treatment composition, particularly a treatment foam, deposited on a lateral surface of the applicator roll, this latter being placed with a rotation axis transversal to the motion of the conveyor belt and having a lateral wall movable away above the operative section of the conveyor belt, a drum placed with the rotation axis transversal to the motion of the conveyor belt and having a lateral surface movable away above the operative section of the conveyor belt, the drum exhibiting a hollow interior destined to house a predetermined quantity of a treatment composition, particularly a treatment foam, and being provided with a predetermined number of spray nozzles or slits for supplying the composition, particularly the foam, a distributor (25) comprising a reservoir (26) configured for receiving the treatment composition, particularly a treatment foam, the reservoir (26) exhibiting at least one supplying nozzle (27) defining an outlet of the reservoir (25), the nozzle (27) extending transversally to the motion of the conveyor belt (2) for all the width of this latter, the distributor (25) comprising one or more pushers, for example one or more toothed wheels, placed inside the reservoir and configured for supplying the treatment composition, particularly the treatment foam from the nozzle (27).

In a 27th aspect according to anyone of the aspects from 3 to 26, wherein the plant comprises:

an applicator of a fixed type extending transversally to a motion direction of the conveyor belt (2) along all the width of this latter; or a plurality of discrete applicators reciprocally facing each other along a direction transversal to the motion of the conveyor belt so that said plurality of applicators covers at least partially, particularly all, the width of the conveyor belt (2), particularly the plurality of applicators are offset according to plural rows transversal to a motion direction of the conveyor belt; or at least one applicator reciprocally movable transversally to a motion direction of the conveyor belt and configured for covering a predetermined width transversal to this latter.

In a 28th aspect according to anyone of the aspects from 3 to 27, the plant comprises at least one auxiliary foam sensor configured for determining the presence of foam in said applicator.

In a 29th aspect according to anyone of the aspects from 3 to 28, the plant comprises at least a further foam sensor—according to the foam sensor of anyone of the aspects from 11 to 15, said further foam sensor being configured for emitting a control signal representative of the foam quantity disposed immediately at a supplying area of the treatment composition performed by the applicator, particularly immediately upstream the blade of the applicator (12);

the control unit (9) being connected to the further foam sensor and configured for receiving the control signal from the further foam sensor and controlling said applicator based on said control signal.

In a 30th aspect according to the preceding aspect, the further foam sensor is configured for generating the control signal which exhibits at least one characteristic related to a side of an accumulation of foam in a predetermined control plane immediately upstream the applicator blade, said control unit being configured for:

receiving said control signal, determining, based on said control signal, a measured value of the size of said accumulation of foam immediately upstream the blade of applicator, comparing said measured value with at least one reference value or range, controlling the supply of foam of the applicator based on a difference between said measured value and said reference value or range of said accumulation.

In a 31st aspect according to the aspect 29 or 30, wherein the control unit is configured for:

commanding said applicator to increase a deposition flow rate of said foam on the belt if the measured value of the size of said foam accumulation immediately upstream the blade of the applicator is less than the reference value or range, and commanding said applicator to reduce the deposition flow rate of foam on the belt if the measured value of the size of said foam accumulation immediately upstream the blade of the applicator is less than the reference value or range.

In a 32nd aspect according to anyone of the preceding aspects, the treating station (4) is configured for applying to the fibrous material (T) a quantity of the treatment composition so that the fibrous material (T) itself exhibits a weight percentage per square meter variation, between a cross-section immediately upstream the treating station (4) wherein the fibrous material has not received the treatment composition, and a cross-section immediately downstream the initial contact area between the fibrous material and the conveyor belt, wherein the fibrous material has received said foam, comprised between 10% and 50%.

In a 33rd aspect according to anyone of the aspects from 4 to 32, the plant comprises at least one control unit (9) active on the conveyor belt (2) and on the treating station (4), said control unit (9) being configured for:

commanding the conveyor belt (2) to move, receiving a desired value of at least one operative parameter representative of a quantity of the treatment composition applied on the sheet fibrous material, said at least one operative parameter comprising at least one of the following:

a weight percentage per square meter variation of the fibrous material between a cross-section immediately upstream the treating station (4), wherein the fibrous material has not received the treatment composition, and a cross-section immediately downstream the treating station (4), wherein the fibrous material has received the treatment composition, a weight percentage per square meter variation of the fibrous material between said cross-section immediately upstream the treating station (4) and a cross-section immediately upstream the printing station (6), a volume flow rate of the treatment composition exiting said treating station, a mass flow rate of the treatment composition exiting said treating station, a thickness of the composition at the depositing section (3*a*), commanding the treating station (4) to manage the application of the treatment composition on the fibrous material (T), as a function of the desired value of the operative parameter and of the movement imparted to said conveyor belt.

In a 34th aspect according to the preceding aspect, the plant comprises at least one sensor capable of emitting a signal regarding the motion of the conveyor belt, said control unit (9) being configured for:

receiving from said sensor a signal regarding the movement of the conveyor belt (2), determining, as a function of said signal, a movement speed of the fibrous material (T) along the advancement direction (A), as a function of the movement speed of the fibrous material (T), commanding to supply the treatment composition for meeting the desired value of said at least one operative parameter, optionally so that the desired values of at least one of the following operative parameters, are met:

the composition exhibits, immediately downstream the treatment composition (4), a thickness less than 5 mm, particularly comprised between 0.5 and 3 mm, a weight percentage per square meter variation of the sheet fibrous material, between a cross-section immediately upstream the treating station (4), wherein the fibrous material has not received the treatment composition, and a cross-section immediately downstream the treating station (4), wherein the fibrous material has received the composition, is comprised between 10% and 50%, the weight percentage per square meter variation of the sheet fibrous material, between said cross-section immediately upstream the treating station (4) and said cross-section immediately upstream the printing station (6), is comprised between 10% and 50%.

In a 35th aspect according to anyone of the aspects from 11 to 34, wherein the control unit (9) is configured for commanding the movement of the conveyor belt (2) for defining an operative condition under which said conveyor belt (2) continuously moves along the advancement direction (A) the fibrous material (T) at a speed constantly comprised between 20 and 100 m/min, particularly comprised between 30 and 70 m/min, particularly wherein the printing station (6) comprises a printing module (7) configured for:

defining a print on all a width of the fibrous material (T), said width being measured normal to the advancement direction (A), staying in a fixed position and printing the second side (T2) of the fibrous material (T) positioned on the operative section (3).

In a 36th aspect, it is provided a process of printing of sheet fibrous material, optionally by using the plant of anyone of the preceding aspects, comprising the following steps:

moving the fibrous material (T) along an advancement direction (A), applying a treatment composition to a first side (T1) of the fibrous material (T), ink-printing, particularly by a digital print, a second side (T2), opposite to the first side (T1), of the fibrous material (T).

In a 37th aspect according to the preceding aspect, the step of applying the composition comprises to deposit this latter directly on the first side (T1) of the sheet fibrous material, since there is no direct deposit of the treatment composition on said second side (T2).

In a 38th aspect according to the aspect 36 or 37, the movement of the fibrous material occurs by a conveyor belt (2) exhibiting an exposed surface configured for receiving the fibrous material (T), the exposed surface constantly exhibiting an operative section (3) configured for temporarily contactingly receiving the first side (T1) of the fibrous material (T) and guiding such fibrous material along an advancement direction (A), the exposed surface of the conveyor belt constantly comprising a depositing section (3*a*) extending upstream the operative section (3) of the conveyor belt (2) itself with respect to the advancement direction (A), wherein the step of applying the treatment composition comprises at least to deposit a predetermined quantity of the treatment composition on the depositing section of the conveyor belt.

In a 39th aspect according to the preceding aspect, the step of applying the treatment composition is performed by an applicator (12) acting on the conveyor belt (2) upstream the operative section (3) with reference to the advancement direction of the sheet fibrous material itself.

In a 40th aspect according to the preceding aspect, the process comprises at least the following steps:

generating a predetermined quantity of the treatment composition, supplying the treatment composition to the applicator (12), wherein the step of applying the treatment composition is performed by one or more of the following:

applying by means of a coating blade placed transversally to the motion of the conveyor belt and distanced above the operative section, applying by means of a spray dispenser distanced above the operative section, applying by means of an applicator roll having an associated respective blade for regulating a thickness of the treatment composition deposited on one lateral surface of the applicator roll, this latter being placed with the rotation axis transversal to the motion of the conveyor belt and with the lateral surface distanced above the operative section of the conveyor belt, applying by means of a drum placed with the rotation axis transversal to the motion of the conveyor belt and with a lateral surface distanced above the operative section of the conveyor belt, the drum exhibiting a hollow interior destined to receive a predetermined quantity of the treatment composition and being provided with a predetermined number of nozzles or slits for supplying the composition, applying by means of a distributor (25) comprising a reservoir (26) configured for receiving the treatment composition, the reservoir (26) exhibiting at least one supplying nozzle (27) defining an outlet of the reservoir (25), the nozzle (27) extending transversally to the motion of the conveyor belt (2) along all the width of this latter, the distributor (25) comprising one or more pushers, for example one or more toothed wheels, placed inside the reservoir and configured for supplying the treatment composition from the nozzle (27).

In a 41st aspect according to anyone of the aspects from 38 to 40, wherein—after the step of applying the treatment composition on the depositing section—the conveyor belt (2) moves the treatment composition to an initial contact area wherein the conveyor belt (2) is estimated to start to come in contact with the fibrous material (T), particularly, the process comprises at least the following sub-steps:

bringing in contact the first side (T1) of the fibrous material (T) with the exposed surface of the conveyor belt (2) so that the same can define the operative section (3) wherein the conveyor belt (2) supports the fibrous material, after the step of bringing in contact, ink-printing, optionally by a digital print, the second side (T2), opposite to the first side (T1), of the fibrous material (T) in contact with the conveyor belt (2).

In a 42nd aspect according to the preceding aspect, the process comprises a step of pressing the fibrous material against the conveyor belt at the initial contact area, for example by means of one or more pressure cylinders.

In a 43rd aspect according to the aspect 41 or 42, moving the treatment composition defines an accumulation of the composition at the initial contact area.

In a 44th aspect according to anyone of the aspects from 36 to 43, the treatment composition comprises a treatment foam comprising at least one of:

an anti-migration agent, a pH control agent, a hydrotropic agent.

In a 45th aspect according to anyone of the aspects from 41 to 44, the process comprises the following steps:

moving the conveyor belt (2), detecting the quantity of the treatment composition, particularly a treatment foam, accumulated at the initial contact area, commanding to supply the treatment composition on the depositing section (3*a*) as a function of the foam quantity accumulated at the initial contact area.

In a 46th aspect according to the preceding aspect, the treatment composition comprises a treatment foam, wherein the process comprises the following steps:

emitting, particularly by a sensor, a control signal representative of the foam quantity placed immediately upstream the initial contact area, determining, for example by a control unit (9), based on said control signal, a measured value of the size of said accumulation of foam, comparing, for example by the control unit (9), said measured value with at least one reference value or range, controlling, for example by the control unit, the applicator based on a difference between said measured value and said reference value or range.

In a 47th aspect according to the preceding aspect, the control step comprises at least the following sub-steps:

commanding the applicator to increase a deposition flow rate of said foam on the belt if the measured value of the size of said accumulation of foam is less than the reference value or range, and commanding the applicator to reduce the deposition flow rate of the foam on the belt if the measured value of the size of said accumulation of foam is greater than the reference value or range.

In a 48th aspect according to anyone of the aspects from 45 to 47, the process comprises the following steps:

emitting, particularly by a monitoring sensor, a signal regarding the motion of the conveyor belt, determining, as a function of said monitoring signal, a movement speed of the fibrous material (T) along the advancement direction (A), as a function of the movement speed of the fibrous material (T), commanding to supply the treatment composition, optionally for meeting a desired value of at least one of the following parameters:

the composition exhibits, on the depositing section, a thickness less than 5 mm, particularly comprised between 0.5 and 3 mm, the weight percentage per square meter variation of the sheet fibrous material, between a cross-section immediately after the applying step, wherein the fibrous material has received the composition, and a cross-section immediately before the step of applying the composition, wherein the fibrous material has not received the foam, is comprised between 10% and 50%, the weight percentage per square meter variation of the sheet fibrous material, between said cross-section immediately before the step of applying the treatment composition and said cross-section immediately before the printing step, is comprised between 10% and 50%.

In a 49th aspect according to anyone of the aspects from 36 to 48, the step of moving the fibrous material (T) is continuously performed at a speed constantly greater than 0, particularly constantly comprised between 20 and 100 m/min, still more particularly is comprised between 30 and 70 m/min, the steps of applying the treatment composition and printing being performed in line during the continuous movement of the sheet fibrous material (T).

BRIEF DESCRIPTION OF THE DRAWINGS

Some embodiments and some aspects of the invention will be described in the following with reference to the attached drawings, given only in an indicative and therefore non-limiting way, wherein.

Figure 8:
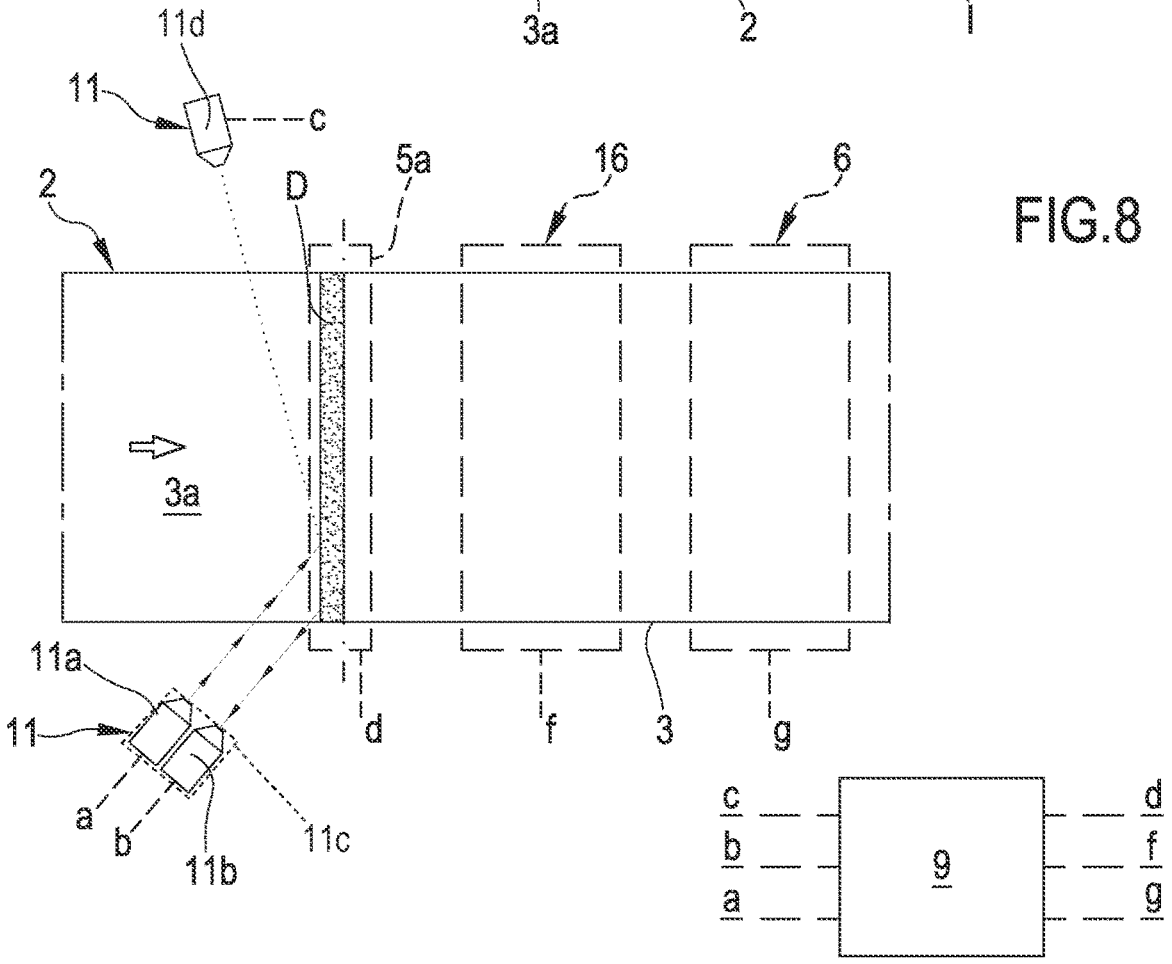
Figure 9:
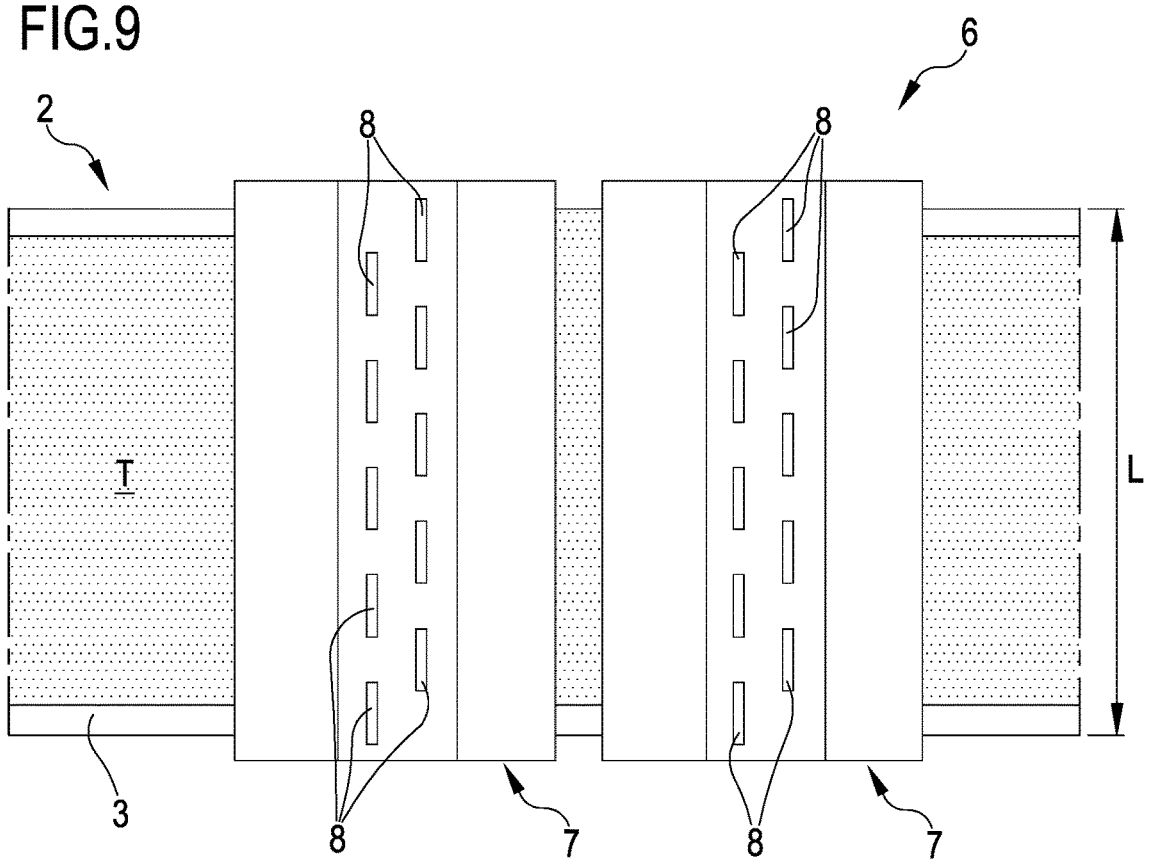
Figure 10:
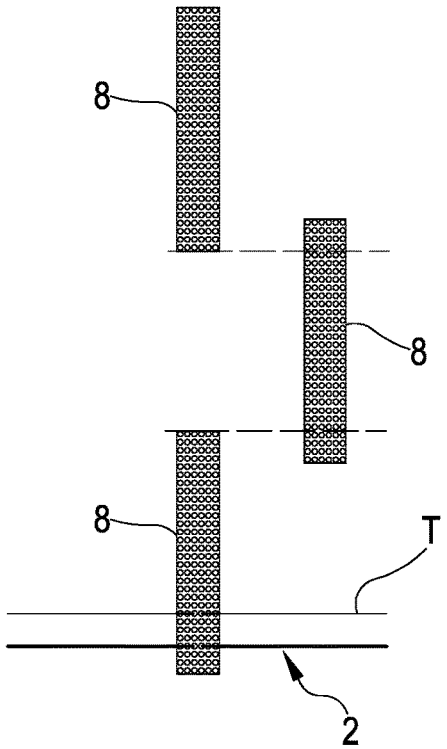
Figure 11:
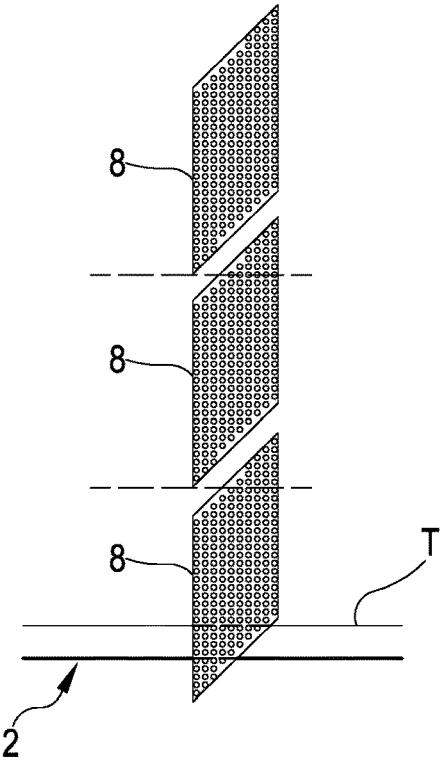

Figures from 3 to 7 are lateral schematic view of an applicator of the treating station of the printing plant according to the present invention;

FIGS. 8 and 9 are respective schematic top views of the printing plant according to the present invention;

FIGS. 10 and 11 are respective schematic views of printing heads of a printing station of the plant according to the present invention.

DEFINITIONS AND MATERIALS

The figures could illustrate the object of the invention by not-to-scale representations; therefore, parts and components illustrated in the figures regarding the object of the invention, could only indicate schematic representations.

In the following description and in the attached claims, the terms listed in the following take the meanings specified in the following.

Ink: a mixture formed by a dispersion of pigments or by a solution of dyes in an aqueous or organic medium destined to be transferred on surfaces of different materials for obtaining one or more prints, for example by digital printing; transparent inks and paints are also comprised. For example, the term ink can be understood as an ink comprising at least one of: a water-based acid ink, a reactive ink, a dispersed ink, a pigment ink, a solvent-based dispersed ink, and a dispersed reactive ink.

The ink for this type of printing can exhibit a viscosity comprised in the range from 1 to 10 mPa·s, preferably from 4 to 8 mPa·s, more preferably about 6 mPa·s measured according to the ASTM D7867-13 method.

Moreover, the ink can exhibit a surface tension comprised in the range from 25 to 45 mN/m, preferably from 30 to 40 mN/m, more preferably about 35 mN/m, measured according to the ASTM D1331-14 method. The viscosity and surface tension were measured at a temperature of 20° C. and at the atmospheric pressure. Further, the operative temperature is comprised in the range between 15° C. and 45° C., preferably between 30° C. and 40° C.; the operative temperature is understood as the temperature of the ink inside a printing head.

A person skilled in the art is capable of selecting the type of ink and also the application conditions and the additives suitable for this type of printing and as a function of the type of fibrous material to be printed.

Fibrous material: a material made of fibers of different type—for example fabric, non-woven fabric, knitted fabric, paper or combinations of one or more of the cited supports. Specifically, the fiber of said fibrous material can be derived from a natural, vegetal or animal, artificial or synthetic source, for example can be a fiber of cotton, flax, manila hemp, jute, wool, viscose or artificial silk, acrylic, polyamide (nylon), polyester, polypropylene, polyethylene, chlorovinyl, polyurethane (Elastam), Teflon (Gore-tex), aramid fibers (Kevlar) or mixtures thereof.

Sheet fibrous material: a fibrous material as hereinbefore defined formed by a structure having two dimensions (length and width) having dimensions substantially prevailing with respect to a third dimension (thickness). The term sheet fibrous material means both a fibrous material consisting of discrete sheets having a limited length (for example the formats A0, A1, A2, A3, A4, etc.) and continuous webs exhibiting a significant length, which can be supplied by a roll on which the sheet material is wound, or can come from an in-line printing step. In any case, the sheet fibrous material, herein described, exhibits two sides or main surfaces, on at least one of which it is provided a print.

Digital printing: printing using one or more nozzle printing heads for applying inks defining motives, patterns, colorations, etc., on sheet materials. The printing heads can be movable transversally to the sheet material advancement direction in order to cover the overall width to be printed, or can be transversally stationary, when the heads width is equal to the printing width, in other words the fabric.

Treatment composition: a composition in the form of a treatment liquid or a treatment foam. The treatment composition comprises one or more liquid compounds, or one or more solid compounds dissolved or dispersed in a suitable liquid phase, having the function of preparing and/or treating at least the surface or surfaces of the sheet fibrous material destined to receive one or more prints. The compound/s can be derived from a natural and/or synthetic (polymers and/or copolymers) sources and can act as one or more of the following: anti-migration agent, thickener, surface tension modifier, acidity modifier, hydrophilicity modifier, hydrophobicity modifier, drying accelerator, fixation improver. The liquid phase can be aqueous, organic, polymeric or mixed.

Treatment liquid: comprises:

at least one anti-migration agent configured for limiting the diffusion of the ink in the fiber of the sheet fibrous material. Such anti-migration agent can for example comprise water-soluble polymers, in other words polymers having a solubility greater than 1%, preferably equal to or greater than 10% of the mass in an aqueous or alkaline solution at 25° C. Particularly, the anti-migration agent can comprise: (sodium, potassium or calcium, preferably sodium) alginates, derivatives of the cellulose, (carboxymethylcellulose, hydroxyethylcellulose), acrylic (co)polymers, xanthan gum, Arabic gum, guar gam and similar; or:

at least one pH control agent (buffering agents). Specifically, the buffering agent can comprise $NaHCO_3$ (adapted in case of materials of cotton printed with reactive colorant ink for maintaining the alkalinity, for example), a weak acid (for example tartaric acid ammonium for controlling the pH, advantageously but in a non-limiting way used in case of silk and similar materials printed with acid colorant ink), and inert organic acid (for example, citric acid, for controlling the pH in case of polyester-based materials and similar printed with a dispersed colorant ink); and at least one hydrotropic agent configured for increasing the moisture contents of the fiber or for increasing the solubility of the colorant. Hydrotropic agents are known to the person skilled in the art and are: urea, thiourea and similar.

Optionally, the treatment liquid can comprise one or more of the following agents:

a surfactant agent configured for increasing the colorant permeability in the fiber. Some surfactants have also the function of anti-migration agents. Such surfactants can comprise non-ionic, anionic surfactants and similar;

an anti-diffusion agent configured for stopping the ink on the sheet fibrous material and/or increasing the color development properties. The anti-diffusion agent can for example comprise silica, alumina, cationic agents and similar. The silica can be used in a silica sol form, in other words as a dispersion.

Other conditioners, such as for example neutral salts, anti-reducing agents, humectants, anti-fermentation agents, and similar.

The neutral salts have the function of accelerating the depletion of the colorant and are mainly applied to the cotton fibers. Such suitable neutral salts are known to the person skilled in the art and include, for example, sodium chloride, sodium sulfate, and similar.

The anti-reducing agent is a substance which prevents the reduction of the colorant and therefore prevents a decrease of the colorant concentration. Suitable anti-reducing agents are known to the person skilled in the art and include, for example, meta-nitro benzene sulfonic acid and similar.

The humectants have the function of moisturizing the fibrous material so that it can be adapted to the ink jet head, and further have the function of controlling the viscosity. Suitable humectants comprise, for example: ethylene glycole, propylene glycole, and similar.

The anti-fermentation agents instead can comprise 2'-dihydroxy-5,5'-dichlorodiphenylmethane.

The treatment liquid can be prepared by mixing one or more of the components by conventional methods. As an alternative, individual liquid compositions such as for example: a liquid composition containing an anti-migration agent, a liquid composition containing an anti-diffusion agent, a liquid composition containing a pH control agent for an acid colourant ink, a liquid composition containing a pH control agent for a dispersed colourant ink, a liquid composition containing a pH control agent for a reactive colourant ink, a liquid composition containing a hydrotropic agent, a liquid composition containing a surfactant, or a liquid composition containing a neutral salt, and/or an anti-reducing agent and similar can be prepared. As an alternative, each individual composition can be applied alone to such fibrous material. Both the individual liquid compositions and the treatment liquid are filtered by a membrane, for example an acetate or cellulose nitrate membrane.

As an alternative, the treatment liquid can be prepared by suitably diluting a concentrated treatment composition, comprising at least one anti-migration agent, a pH control agent, a hydrotropic agent and, optionally, one or more of the other components as hereinbefore defined. The concentrated composition can be in the form of a paste, preferably having a viscosity of about 300-500 cP measured according to the Brookfield method.

The treatment liquid, according to the invention, generally has a viscosity greater than 2.0 cP, preferably greater than 5 cP, particularly comprised between 10 and 20 cP. Such viscosity is measured by a DV-II+Viscometer instrument (Brookfield Inc.). Generally, the treatment liquid has a surface tension greater than 20 $N/cm^2$, preferably greater than 25 $N/cm^2$, greater than 30 $N/cm^2$; and/or less than 70 $N/cm^2$, less than 65 $N/cm^2$, less than 60 $N/cm^2$. Generally, such treatment liquid has a surface tension comprised in the range from 20 to 70 $N/cm^2$. Such surface tension is measured by a Surface Tensiomat 21 instrument (Fisher Scientific Inc.).

The viscosity and surface tension were measured at a temperature of 20° C. and at the atmospheric pressure.

In a general formulation of the treatment liquid, the same comprises at least one of:

- at least one anti-migration agent, preferably selected among: alginates, derivatives of the cellulose, particularly carboximethylcellulose, hydroxyethylcellulose, acrylic (co)polymers, xanthan gum, Arabic gum, and guar gum;
- at least one pH control agent, preferably selected among sodium bicarbonate, sodium carbonate, ammonium sulfate, ammonium tartrate, and citric acid,
- at least one hydrotropic agent, preferably selected between urea and thiourea.

Optionally, the treatment liquid comprises:

- at least one anti-migration agent, preferably selected among: alginates, derivatives of the cellulose, such as carboximethylcellulose, hydroxyethylcellulose, acrylic (co)polymers, xanthan gum, Arabic gum, and guar gum; and/or
- at least one pH control agent, preferably selected among: sodium bicarbonate, sodium carbonate, ammonium sulfate, ammonium tartrate, and citric acid, and at least one hydrotropic agent, preferably selected between urea and thiourea.

Optionally, the treatment liquid can further comprise at least one surfactant and/or a neutral salt and/or an anti-reducing agent and/or one humectant and/or one anti-fermentation agent.

In a first embodiment, the treatment liquid can comprise:

- sodium alginate, preferably in a percentage comprised between 0.1% and 1% wt. with respect to the total weight of the composition, and an acrylic (co)polymer, more preferably, Thermacol MP, preferably in a percentage comprised between 8% and 12% wt. with respect to the total weight of the composition, and
- water in a quantity needed to reach 100%.

In an embodiment variant of the first embodiment of the treatment liquid, this latter can comprise:

- an acrylic (co)polymer, preferably in a percentage comprised between 10% and 20% wt., and optionally guar gam, preferably in a percentage comprised between 0.1% and 1% wt. with respect to the total weight of the composition,
- water in a quantity needed to reach 100%.

In an embodiment variant of the first embodiment, the treatment liquid can comprise:

- an anti-migration agent, for example hydroxyethylcellulose, preferably in a percentage comprised between 3% and 7% wt. with respect to the total weight of the composition,
- a surfactant, for example FLUORAD FC170, preferably in a percentage comprised between 0.1% and 0.5% wt. with respect to the total weight of the composition,
- a humectant, for example glycerine, preferably in a percentage comprised between 1% and 4% wt. with respect to the total weight of the composition, and
- water in a quantity needed to reach 100%.

The above described treatment liquid does not comprise both pH control agents and hydrotropic agents. The treatment liquid, defined in the second embodiment, is suitable for interacting with a dispersed ink which does not require both to use pH control agents and hydrotropic agents; further such treatment liquid enables to apply the anti-migration agent separately from the pH control agent and from the hydrotropic agent when reactive or acid ink is used.

In a second embodiment, the treatment liquid can comprise:

- sodium bicarbonate and/or sodium carbonate, in a percentage comprised between 2.5% and 3% wt. with respect to the total weight of the composition,
- urea, preferably in a percentage comprised between 6% and 18% wt. with respect to the total weight of the composition, and
- water in a quantity needed to reach 100%.

In an embodiment variant of the second embodiment of the treatment liquid, this latter can comprise:

- ammonium sulfate (solution 1:2) or ammonium tartrate, preferably in a percentage comprised between 4% and 8% wt. with respect to the total weight of the composition,
- urea, preferably in a percentage comprised between 6% and 15% wt. with respect to the total weight of the composition, and
- water in a quantity needed to reach 100%.

The treatment liquid defined in the second embodiment does not comprise anti-migration agents and is adapted to interact with pigment inks, which do not require to use anti-migration agents.

Moreover, as an individual composition, the above defined treatment liquid enables to apply the pH control and hydrotropic agents separately from the anti-migration agent when a reactive or acid ink is used.

In a third embodiment, the treatment liquid can comprise:

- at least one anti-migration agent, preferably selected between alginates, acrylic (co)polymers and guar gam,
- at least one pH control agent, preferably selected among sodium bicarbonate, sodium carbonate, ammonium sulfate and ammonium tartrate,
- at least one hydrotropic agent preferably urea.

Preferably, according to the third embodiment, the treatment liquid, for example adapted to interact with reactive inks, can comprise:

- alginate, preferably in a percentage comprised between 0.1% and 1% wt. with respect to the total weight of the composition, and an acrylic (co)polymer, preferably Thermacol MP, preferably in a percentage comprised between 8% and 12% wt. with respect to the total weight of the composition, sodium bicarbonate and/or sodium carbonate, preferably in a percentage comprised between 2.5% and 3% wt. with respect to the total weight of the composition, urea, preferably in a percentage comprised between 6% and 18% wt. with respect to the total weight of the composition, an anti-reducing agent, preferably sodium salt of the 3-nitro benzene sulfonic acid (Lyoprint RG) preferably in a percentage comprised between 0.5% and 1% wt. with respect to the total weight of the composition, and water in a quantity needed to reach 100%.

Preferably, according to the third embodiment, the treatment liquid, for example adapted to interact with an acid ink, can comprise:

an acrylic (co)polymer, preferably Thermacol MP, preferably in a percentage comprised between 10% and 20% wt., and optionally guar gam, preferably in a percentage comprised between 0.1% and 1% wt. with respect to the total weight of the composition, ammonium sulfate or ammonium tartrate, preferably in a percentage comprised between 4% and 8% wt. with respect to the total weight of the composition, urea, preferably in a percentage comprised between 6% and 15% wt. with respect to the total weight of the composition, and optionally an anti-fermentation agent, preferably 2,2'-dihydroxy-5, 5'-dichlorodiphenylmethane (Prevental), preferably in a percentage comprised between 0.01% and 0.15% wt. with respect to the total weight of the composition, and water in a quantity needed to reach 100%.

Another example of a treatment liquid according to the third embodiment comprises:

at least one anti-migration agent, preferably selected between carboxymethylcellulose and hydroxyethylcellulose, at least one pH control agent, preferably selected among sodium carbonate, ammonium tartrate, and citric acid, at least one hydrotropic agent, preferably urea, at least one surfactant, preferably a non ionic surfactant, more preferably Triton X100 and at least one humectant, preferably glycerine.

Another example of the treatment liquid according to the third embodiment comprises:

carboxymethylcellulose, preferably in a percentage comprised between 1% and 3% wt. with respect to the total weight of the composition, sodium bicarbonate, preferably in a percentage comprised between 3% and 7% wt. with respect to the total weight of the composition, urea, preferably in a percentage comprised between 3% and 7% wt. with respect to the total weight of the composition, Triton X100, preferably in a percentage comprised between 3% and 7% wt. with respect to the total weight of the composition, and glycerine, preferably in a percentage comprised between 3% and 7% wt. with respect to the total weight of the composition, and water in a quantity needed to reach 100%.

The above defined treatment liquid is advantageously adapted to interact with reactive inks.

Another example of a treatment liquid according to the third embodiment comprises:

hydroxyethylcellulose, preferably in a percentage comprised between 1.5% and 4% wt. with respect to the total weight of the composition, ammonium tartrate, preferably in a percentage comprised between 1.5% and 4% wt. with respect to the total weight of the composition, urea, preferably in a percentage comprised between 3% and 7% wt. with respect to the total weight of the composition, Triton X100, preferably in a percentage comprised between 0.1% and 1% wt. with respect to the total weight of the composition, and glycerine, preferably in a percentage comprised between 3% and 7% wt. with respect to the total weight of the composition, and water in a quantity needed to reach 100%.

The above defined treatment liquid is advantageously adapted to interact with an acid colourant ink.

Another example of the treatment liquid according to the third embodiment comprises:

carboxymethylcellulose, preferably in a percentage comprised between 0.5% and 3% wt. with respect to the total weight of the composition, citric acid, preferably in a percentage comprised between 0.05% and 1% wt. with respect to the total weight of the composition, urea, preferably in a percentage comprised between 3% and 7% wt. with respect to the total weight of the composition, Triton X100, preferably in a percentage comprised between 0.1% and 1% wt. with respect to the total weight of the composition, and glycerine, preferably in a percentage comprised between 3% and 7% wt. with respect to the total weight of the composition, and water in a quantity needed to reach 100%.

The above defined treatment liquid is advantageously, but in a non-limiting way, adapted to interact with a dispersed ink.

Examples of individual compositions useable in the present invention, are listed in the following:

In a first embodiment variant, an individual composition can comprise:

a hydrotropic agent, for example urea, preferably in a percentage comprised between 3% and 7% wt. with respect to the total weight of the composition, a surfactant, FLUORAD FC170 for example, preferably in a percentage comprised between 0.1% and 0.5% wt. with respect to the total weight of the composition, a humectant, for example glycerine, preferably in a percentage comprised between 1% and 4% wt. with respect to the total weight of the composition, and water in a quantity needed to reach 100%.

In a further embodiment variant, an individual composition can comprise:

sodium bicarbonate, preferably in a percentage comprised between 3% and 7% wt. with respect to the total weight of the composition, a surfactant, FLUORAD FC170 for example, preferably in a percentage comprised between 0.1% and 0.5% wt. with respect to the total weight of the composition, a humectant, for example glycerine, preferably in a percentage comprised between 1% and 4% wt. with respect to the total weight of the composition, and water in a quantity needed to reach 100%.

This latter defined individual liquid composition is advantageously, but in a non-limiting way, adapted to interact with reactive colourant inks.

In a further embodiment variant, an individual composition can comprise:

ammonium tartrate or ammonium sulfate, preferably in a percentage comprised between 3% and 7% wt. with respect to the total weight of the composition, a surfactant, FLUORAD FC170 for example, preferably in a percentage comprised between 0.1% and 0.5% wt. with respect to the total weight of the composition, a humectant, for example glycerine, preferably in a percentage comprised between 1% and 4% wt. with respect to the total weight of the composition, and water in a quantity needed to reach 100%.

The above defined individual liquid composition is advantageously, but in a non-limiting way, adapted to interact with acid colourant inks.

In a further embodiment variant, an individual composition can comprise:

citric acid, preferably in a percentage comprised between 3% and 7% wt. with respect to the total weight of the composition, a surfactant, FLUORAD FC170 for example, preferably in a percentage comprised between 0.1% and 0.5% wt. with respect to the total weight of the composition, a humectant, for example glycerine, preferably in a percentage comprised between 1% and 4% wt. with respect to the total weight of the composition, and water in a quantity needed to reach 100%.

The above defined individual liquid composition is advantageously, but in a non-limiting way, adapted to interact with dispersed colourant inks.

In a further embodiment variant, an individual composition can comprise:

a surfactant, Triton X-705 for example, preferably in a percentage comprised between 3% and 7% wt. with respect to the total weight of the composition, a surfactant, FLUORAD FC170 for example, preferably in a percentage comprised between 0.1% and 0.5% wt. with respect to the total weight of the composition, a humectant, glycerine for example, preferably in a percentage comprised between 1% and 4% wt. with respect to the total weight of the composition, and water in a quantity needed to reach 100%.

Treatment foam: comprises a dispersion of a gas in a liquid medium; further the foam can exhibit the characteristics of colloidal dispersions. The foam can be obtained by directly blowing a high-pressure gas into the liquid medium or by exploiting foaming agents.

In an embodiment, the treatment foam comprises the treatment liquid, as hereinbefore described and, optionally, one or more additives such as for example: foaming agents, wetting agents and viscosity modifying agents.

Suitable foaming agents are known to the person skilled in the art, and comprise, for example, surfactants, for example cationic, anionic, amphoteric, non-ionic surfactants; for example, alkyl betaines, particularly laurylamidopropylbetaine, can be used.

Adapted wetting agents comprise, for example, silicone derivatives. Viscosity modifying agents comprise, for example, modified or substituted cellulose and poly(meth) acrylic acids and salts thereof, such as for example, ammonium salts, preferably: hydroxyethylcellulose, carboxymethylcellulose and cellulose dimethylpropane sulfonate.

The composition defining the treatment foam can, for example, comprise:

a treatment liquid in a percentage comprised between 5% and 75%, preferably between 10% and 60% wt. with respect to the total weight of said composition, at least one foaming agent in a percentage comprised between 0.2% and 5%, preferably between 0.4% and 2% wt. with respect to the total weight of said composition, water in a quantity needed to reach 100%.

The wetting agent, if present in the composition of the treatment liquid used for producing the foam, has a percentage comprised between 0.001% and 5%, preferably from 0.01% to 1% wt. with respect to the total weight of said composition. The viscosity modifying agent, if present in the composition of the treatment liquid used for producing the foam, has a percentage comprised between 0.001 and 5%, preferably from 0.01% to 1% wt. with respect to the total weight of said composition.

The medium which can be used for producing the foam of the invention is well known to the person skilled in the art, and many different mediums are commercially available. For example, in case a gas, for example air, is directly blown at high pressure into the liquid medium and/or in case foaming agents are used, a mechanical stirrer, a conventional mixer, or a foam generator can be used.

The density of the treatment foam is greater than 0.005 $g/cm^3$, preferably is comprised between 0.01 $g/cm^3$ and 0.3 $g/cm^3$; the foam density was obtained by introducing a determined foam volume in a graduated laboratory cylinder of a known weight, by determining the weight of the foam and calculating the density from the known volume and weight. The expansion ratio of the treatment foam, defined as the ratio between the weight of the liquid and a weight of the same volume of foam prepared by this liquid, is comprised between 2:1 and 6:1, preferably between 3:1 and 5:1.

The average diameter of the cells of the foam, according to the invention, is greater than 0.05 mm, preferably comprised between 0.08 and 0.5 mm. The average diameter of the cells of the foam was measured by placing a foam sample on a microscope slide, by observing with a microscope having an enlargement of 32 times, and by counting the number of cells in an area of 6.77 $mm^2$. Particularly, the average diameter D of the cells, measured in mm, was determined by the equation:

$$D=2/\sqrt{\pi}\cdot[(6.77)(\text{liquid density}-\text{foam density})/\text{cells number}]^{1/2}$$

Preferably, the treatment foam can comprise:

a treatment liquid in a percentage comprised between 5 and 75% wt. with respect to the total weight of the foam, such treatment liquid can comprise:

at least one anti-migration agent, preferably selected among alginates, derivatives of the cellulose, such as carboximethylcellulose, hydroxyethylcellulose, acrylic (co)polymers, xanthan gum, Arabic gum, and guar gum, and/or at least one pH control agent, preferably selected among: sodium bicarbonate, sodium carbonate, ammonium sulfate, ammonium tartrate, and citric acid, and at least one hydrotropic agent, preferably selected between urea and thiourea, at least one foaming agent in a percentage comprised between 0.2% and 5%, preferably between 0.4 and 2% wt. with respect to the total weight of the foam, water in a quantity needed to reach 100%.

Hydrophobicity: the term water-repellency or hydrophobicity means the physical properties of chemical species (for example molecules) of being repelled by water. Moreover, this term is used with a more general meaning for denoting the property of materials of not absorbing and not retaining water inside them or on their surface.

The variation of hydrophobicity of the fibrous material before and after the plasma-treatment is measured by the contact angle, in other words the magnitude of the angle, measured in Angstrom degrees, present between the surface of the fibrous material and the tangent to the liquid-vapour interface of a water drop. The hydrophobicity variation of the fibrous material before and after the plasma treatment according to the invention, can be measured when the surface of a sample of the fibrous material contacts a distilled water drop 1 cm high for 60 seconds, by measuring the quantity in grams of distilled water absorbed by the material, and weighing the sample of the material before and after the test. The results are expressed in grams/$m^2$ of absorbed water.

Standard atmosphere: an atmosphere at a temperature of 288.15 K (15° C.), at a pressure of 101.325 kPa (1 tm) and at a humidity of 0.00.

DETAILED DESCRIPTION

Printing Plant

1 generally indicates a plant for printing, particularly for digitally printing, a sheet fibrous material T, for example as a discrete sheet or as continuous web. The plant 1, object of the invention, is useable for ink-printing at least one side of said sheet fibrous material T which, for example, can be formed by or can comprise a fabric and/or non-woven fabric. Generally, but in a non limiting way, the plant 1 can be applied in the textile or knitted fabric or non-woven fabric industry for printing by ink.

As it is visible in the attached figures, the plant 1 comprises at least one conveyor belt 2 movable along a closed path, particularly between at least one first and one second end idler members 2*a*, 2*b*. The conveyor belt 2 exhibits a structure having two dimensions: length and width (the width is identified by the letter L as illustrated in FIG. 11), substantially prevalent with respect to a third dimension, such as the thickness; the length is defined along the outline of the belt; particularly the operative length is defined along the movement direction of the operative section of the belt 2, on which the sheet material abuts, while the width L is defined normal to said direction. The conveyor belt 2 is defined by a continuous layer having a substantially constant width along all the development of the conveyor 2 itself.

The conveyor belt 2 exhibits two main surfaces or sides: an exposed surface S and an inner surface I. The inner surface I is configured for directly contacting the idler members 2*a*, 2*b* adapted to guide the operative section of the belt 2 along the cited movement direction, while the exposed surface S is configured for receiving the fibrous material T; particularly, the exposed surface S is configured for facing and receiving a first side T1 of the sheet fibrous material T. In a preferred, but non limiting configuration of the invention, the conveyor belt 2—at least at a continuous longitudinal band of the exposed surface S destined to receive the sheet fibrous material T—is devoid of through openings crossing the thickness of the belt 2 itself; particularly, at least the exposed surface S destined to receive the sheet fibrous material T is completely smooth, devoid of holes (through openings, for example) and advantageously devoid of valleys and projections. Advantageously, but in a non-limiting way, the conveyor belt 2 comprises at least one continuous layer of water-proof material defining the exposed surface and capable of providing the surface itself, according to a view normal to the movement direction, with a continuous and preferably rectilinear outline. For example, the conveyor belt 2 can be made at least partially of at least one material selected in the group of the following: elastomeric materials, silicone, silicone rubber or other.

Figure 1:
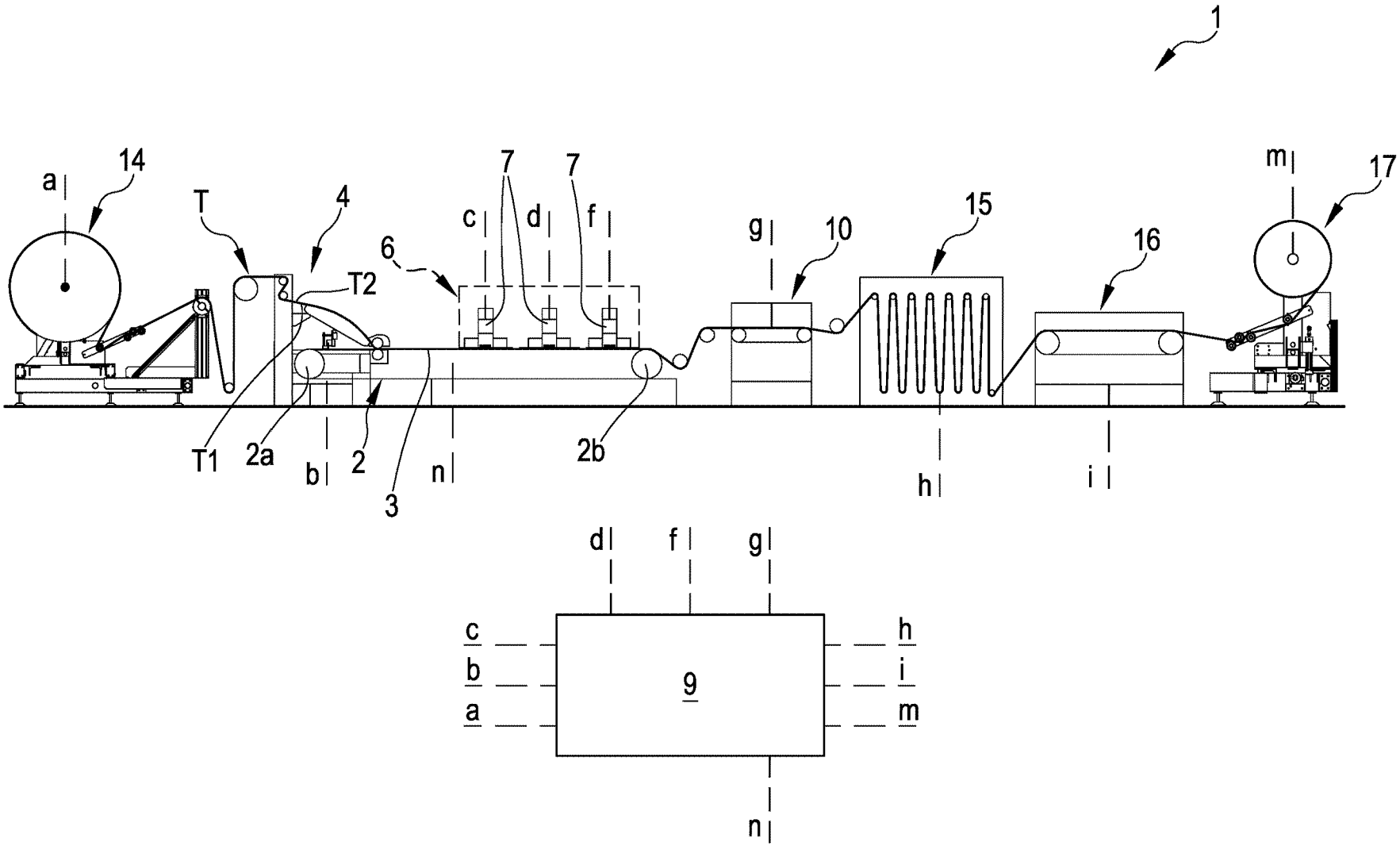
FIG. 1 is a schematic view of a printing plant according to the present invention.

The exposed surface S of the conveyor belt 2 exhibits constantly an operative section 3 configured for temporarily contactingly receiving the first side T1 of the fibrous material T. De facto, at least part of the closed path of the conveyor belt 2 defines the operative section 3 for transporting the fibrous material T; the operative section 3 is defined by the portion of the belt 2 which moves the fibrous material T, in other words from the portion of the belt 2 directly supporting the fibrous material T. The operative section 3 is defined by a portion of the path between the first and second idler members as illustrated in FIG. 1 for example. Particularly, the operative section 3 extends substantially from the second idler member 2*b* towards the first idler member 2*a*.

In a preferred but non-limiting arrangement of the invention, the conveyor belt 2 comprises only the first and second idler members and therefore exhibits a substantially rectangular closed path, radiused at said members; under such condition, the operative section 3 is defined by a rectilinear portion of the rectangular path: the material T therefore would be transported by the belt 2 along a rectilinear section, particularly a flat one. De facto, the conveyor belt 2 is configured for temporarily receiving and supporting the fibrous material T; during the movement of the conveyor belt 2, this latter is configured for guiding the fibrous material T moving along an advancement direction A (see FIG. 2, for example). The movement of the conveyor belt 2—and also of the fibrous material T—is allocated to at least one motor active on one or more idler members of the conveyor belt 2. In an embodiment of the invention, at least part of the exposed surface S of the conveyor belt 2 is made adhesive: the conveyor belt 2 is configured for temporarily constraining the fibrous material T at the operative section 3. In a preferred but non-limiting embodiment of the invention, the exposed surface S is treated with a non-water-soluble adhesive material; particularly, the exposed surface treated by the adhesive material, comprises a polymeric glue sensitive to at least one between pressure and temperature.

As it is visible in the attached figures, the exposed surface of the conveyor belt 2 comprises constantly a depositing section 3*a* extending upstream the operative section 3 of the conveyor belt 2 itself with respect to the advancement direction A. As it will be better described in the following, the depositing section 3*a* of the exposed surface S is configured for receiving a treatment composition M adapted to contact the fibrous material T in the operative section 3.

The depositing section 3*a* extends on the same rectilinear section of the rectangular closed path of the conveyor belt 2 on which said operative section 3 is defined. More particularly, the depositing section 3*a* extends substantially from the first idler member 2*a* towards the second member 2*b*. Still more particularly, the depositing section 3*a* extends from the first idler member 2*a* to the operative section 3: the depositing section 3*a* and operative section 3 are immediately consecutive to each other along the advancement direction A of the fibrous material T.

From the dimensional point of view, the conveyor belt 2 is configured for exhibiting a width L equal to or greater than a maximum width of the fibrous material T (see FIG. 11, for example); such widths are measured normal to the advancement direction A of the fibrous material T. The operative section 3 is defined by the cross-section of the belt 2 adapted to contact and support the fibrous material T. In a preferred but non-limiting arrangement of the invention, the operative section 3 extends along a rectilinear prevalent development direction: under a condition of use of the plant 1, such prevalent development direction of the operative section 3 is substantially horizontal. The longitudinal extension or length of the operative section 3 is comprised between 0.5 and 10 meters, particularly between 0.5 and 6 meters; the length of the operative section 3 of the conveyor belt 2 is measured along the movement direction of the operative section of the conveyor belt 2 itself, particularly along the advancement direction A of the fibrous material T. The operative section 3 and depositing section 3*a* exhibit a respective length measured along the advancement direction A of the fibrous material T; the ratio of the length of the operative section 3 to the length of the depositing section 3*a*, is greater than 1, particularly is comprised between 1.5 and 5.

The conveyor belt 2—during a predetermined operative condition—is configured for moving continuously the fibrous material T at a speed constantly greater than 0 along the advancement direction A. During the operative condition of the conveyor belt 2, the same is always and constantly moving. Still in other words, during the operative condition of the conveyor belt 2, the same does not provide to alternately move step-by-step, wherein dwells of the belt along the moving direction are provided.

Figure 3:
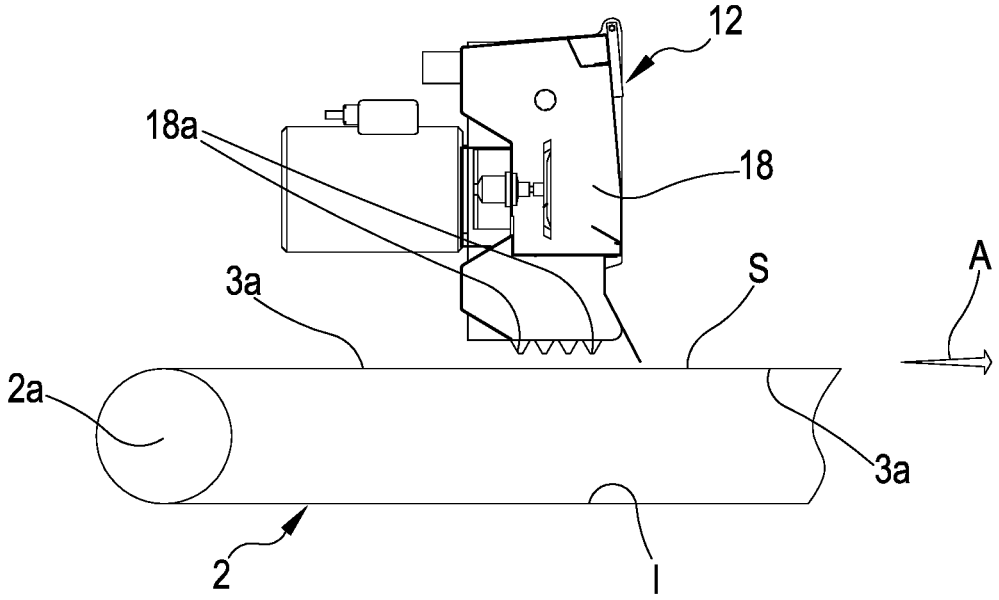

In a preferred but non-limiting arrangement of the invention, the plant 1 comprises at least one control unit 9 (outlined in FIG. 1, for example) active on the conveyor belt 2—particularly on the motor—which is configured for commanding the conveyor belt 2 to move (see for example FIG. 3 wherein the control unit 9 is connected to the conveyor belt 2 by means of the connecting line "n"). Particularly, the control unit 9 is configured for defining the operative condition wherein the conveyor belt 2 is configured for continuously moving, along the advancement direction A, the fibrous material T at a speed constantly comprised between 20 and 100 m/min, particularly comprised between 30 and 70 m/min. In an arrangement of the plant 1, this latter comprises at least one movement sensor engaged with the conveyor belt 2 and capable of emitting a signal regarding the motion of the conveyor belt 2. The control unit 9 is connected to the movement sensor and is configured for:

- receiving, from the movement sensor, a monitoring signal regarding the movement of the conveyor belt 2,
- managing, as a function of said monitoring signal, a movement speed of the conveyor belt 2 and therefore a movement speed of the fibrous material T along the advancement direction A.

As hereinbefore discussed, the depositing section 3*a* is configured for receiving a treatment composition. The conveyor belt 2—due to the motion thereof—is configured for transporting the treatment composition applied on the depositing section 3*a* to an initial contact area wherein the conveyor belt 2 is estimated to start to come in contact with the fibrous material T supplied along said operative path. Particularly, the initial contact area is a connecting area between the depositing section 3*a* and operative section 3: the depositing section, initial contact area and operative section are immediately consecutive to each other and extend, without interruption, along the closed operative path of the belt 2, particularly along the advancement direction A of the fibrous material T.

Advantageously but in a non-limiting way, the plant 1 comprises at least one pressure organ 5*a* (see FIGS. 2 and 2B)—optionally comprising at least one pressure cylinder—operating above the exposed surface S of the conveyor belt at the initial contact area. The pressure organ is configured for acting under pressure on the fibrous material T supplied along the operative path, by thrusting said fibrous material against the exposed surface of the conveyor belt and for promoting a continuous adhesion. Specifically, the pressure organ 5*a* is configured for thrustingly acting directly on a second side T2 of the fibrous material (FIG. 2B)—opposite to the first side T1—in order to enable the contact and adhesion of the first side T1 to the belt 2, particularly to the exposed surface.

Moreover, the plant 1 can comprise an anvil pressure organ 5*b* (see FIGS. 2 and 2B), optionally comprising at least one anvil pressure cylinder, operating below the exposed surface S of the conveyor belt 2 at said initial contact area. Particularly, the anvil pressure organ 5*b* is active on the inner surface I of the conveyor belt 2 opposite to the organ 5*a*: the anvil pressure organ 5*b* is configured for supportingly acting on the conveyor belt 2 in opposition to the pressure organ 5*a*.

The initial contact area of the belt is—with the fibrous material—interposed between the pressure organs 5*a* and 5*b*.

Advantageously, at least the pressure organ 5*a* (optionally both the pressure organ 5*a* and anvil organ 5*b*) extend transversally to the conveyor belt 2 (particularly normal)—with respect to said movement direction and particularly with respect to the advancement direction A of the fibrous material T—for defining a length substantially identical to the width of the sheet fibrous material. More particularly, each pressure organ exhibits a length substantially equal to the width L of the belt 2.

Advantageously, at least the pressure organ 5*a* comprises a completely smooth (devoid of cavities and/or through openings) outer circular contact surface of waterproof material.

As it is visible in FIG. 1 for example, moreover the plant comprises a treating station 4 configured for treating the fibrous material with a treatment composition M—comprising a treatment liquid and/or foam—by applying the composition itself on the first side T1 of the fibrous material T. The treating station 4 is configured for enabling to directly apply the treatment composition M on the first side T1 of the fibrous material T. Indeed, the treatment composition M directly contacts the first side T1 of the fibrous material; at the initial contact area, the composition M is thrusted through the fibrous material from the first side T1 for enabling to treat this latter.

The treating station 4 comprises at least one applicator 12 of the treatment composition, operating below the fibrous material T supplied along the operative path. Particularly, the applicator 12 is disposed upstream the pressure organ 5*a* with respect to the movement direction, particularly with respect to the advancement direction A of the fibrous material T.

More specifically, the applicator 12 is positioned and configured for disposing the treatment composition M on the exposed surface S of the depositing section 3*a* of the conveyor belt 2. De facto, the applicator 12 deposits the treatment composition on the portion of the conveyor belt 2 which does not still contact the fibrous material T.

After moving the belt, the treatment composition M applied on the exposed surface is guided to the initial contact area wherein the composition is brought in direct contact with the first side T1 of the fibrous material. The contact of the belt with the fibrous material causes the composition to treat the fibrous material T from the first side T1: the composition passes through at least part of the thickness of the fibrous material for enabling the treatment.

As hereinbefore described, in an embodiment of the invention, the conveyor belt 2 defines an operative condition wherein the same continuously moves the fibrous material T constantly at a speed greater than 0; the treating station 4 is configured for disposing, during the predetermined operative condition, on the depositing section 3*a*, the treatment composition M. More particularly, the conveyor belt 2, during the operative condition, is configured for continuously moving the fibrous material T through the treating station 4 which deposits continuously the treatment composition M on the section 3*a*.

The treatment composition M supplied by the treating station 4, independently from the liquid or foam state of the treatment composition, can comprise for example one of the following agents: an anti-migration agent, a pH control agent, a hydrotropic agent.

The treating station 4 is configured for disposing, on the sliding section 3*a*, a predetermined quantity of the treatment composition M; said quantity of the treatment composition M is selected so that the treated fibrous material T (the fibrous material which has received the treatment composition) exhibits a weight percentage per square meter variation, between a cross-section immediately upstream the pressure organ 5*a* (the fibrous material which is not still in contact with the treatment composition) and a cross-section immediately downstream the pressure organ 5*a*, less than 70%, particularly comprised between 10% and 50%, still more particularly comprised between 10% and 30%.

As hereinbefore described, in a configuration of the plant 1, the same comprises the control unit 9. In a preferred but non-limiting embodiment of the invention, the treatment composition M comprises, and particularly is, a treatment foam, and the plant 1 comprises:

- at least one foam sensor 11 configured for emitting a control signal representative of the foam quantity placed immediately upstream the initial contact area,
- the control unit 9 connected to the foam sensor 11 (see the connecting lines a, b, c in FIG. 8, for example) and to the applicator 12. The control unit 9 is configured for receiving said control signal and controlling the applicator 12 based on said control signal.

More particularly, the foam sensor 11 is configured for generating said control signal which exhibits at least one characteristic related to a size of the foam accumulation in a predetermined control plane, said control unit being configured for:

- receiving said control signal,
- determining, based on said control signal, a measured value of the size of said foam accumulation,
- comparing said measured value with at least one reference value or range,
- controlling said applicator 12 based on a difference between said measured value and said reference value or range.

Still more particularly, the control unit 9 is configured for:

- commanding said applicator to increase a deposition flow rate of said foam on the belt if the measured value of the size of said foam accumulation is less than the reference value or range, and
- commanding said applicator to reduce the deposition flow rate of the foam on the belt 2 if the measured value of the size of said foam accumulation is greater than the reference value or range, The sensor 11, as illustrated in FIG. 8, can comprise:

- an emitter 11*a* of a primary signal configured for emitting said primary signal towards said initial contact area;
- a receiver 11*b* of a secondary signal, returning from said foam accumulation possibly present upstream said contact area, responsive to said primary signal. Based on the secondary signal, said receiver 11*b* is configured for generating the control signal which exhibits said at least one characteristic related to the size of said foam accumulation in a predetermined control plane.

The primary signal can comprise an electric, electromagnetic or acoustic signal. The secondary signal can comprise an electric, electromagnetic or acoustic signal.

As an alternative, the foam sensor 11 can comprise:

- a first presence sensor 11*c* (FIG. 8) placed and configured for determining the presence of a foam accumulation upstream said contact area having a size along a predetermined direction greater than a minimum value, and
- a second presence sensor 11*d* (FIG. 8) distanced form the first presence sensor, placed and configured for determining the presence of a foam accumulation upstream said contact area having a size along a predetermined direction greater than a maximum value.

Moreover, the plant 1 can comprise at least one movement sensor connected to the conveyor belt 2 and configured for emitting a monitoring signal representative of a movement speed of the conveyor belt along the advancement direction A. The control unit is connected to the movement sensor and is configured for receiving said monitoring signal and controlling said applicator based on said monitoring signal.

Particularly, the control unit is configured for:

- receiving, for example from the movement sensor engaged with the conveyor belt 2, a signal regarding the movement of the conveyor belt 2,
- determining, as a function of the monitoring signal, a measured value of the movement speed of the conveyor belt 2 along the advancement direction A, particularly the movement speed of the fibrous material T along the advancement direction A,
- controlling the applicator based on the measured value of the movement speed of the conveyor belt, particularly as a function of the movement speed of the fibrous material T. Particularly, controlling the quantity (flow rate) of the treatment composition supplied by the applicator.

Particularly, the control unit is configured for:

- commanding the applicator 12 to increase a deposition flow rate of the treatment composition if the measured value of the movement speed of the conveyor belt 2 is less than the reference value or range, and
- commanding the applicator 12 to reduce the deposition flow rate of the treatment composition if the measured value of the movement speed of the conveyor belt 2 is greater than the reference value or range.

The quantity of the treatment composition, managed by the control unit 9 by means of the applicator 12, is selected so that the fibrous material T itself exhibits a weight percentage per square meter variation, between a cross-section immediately upstream the pressure organ 5*a* (the material has not still received the composition) and a cross-section immediately downstream the pressure organ 5*a*, less than 70%, particularly comprised between 10% and 50%, still more particularly between 10% and 30%.

More particularly, in a first example, the applicator 12 of the treating station 4 comprises at least one nozzle dispenser 18 (FIG. 3) distanced above the operative section 3. The applicator 12 can comprise a single spray dispenser 18 extending all along the width of the conveyor belt 2 and exhibiting a plurality of nozzles 18*a* (FIG. 3) enabling the dispenser 18 to apply the treatment composition on all the width of the fibrous material T. In an embodiment variant of the first example, the applicator 12 can comprise a plurality of spray dispensers 18, each of them exhibits one or more supplying nozzles 18*a*, configured for enabling to apply the treatment composition M on all the length of the fibrous material T.

The applicator 12 is configured for applying on the exposed surface S of the conveyor belt, a treatment foam exhibiting, immediately downstream the applicator 12, a thickness less than 5 mm, particularly comprised between 0.5 and 3 mm.

Figure 2:
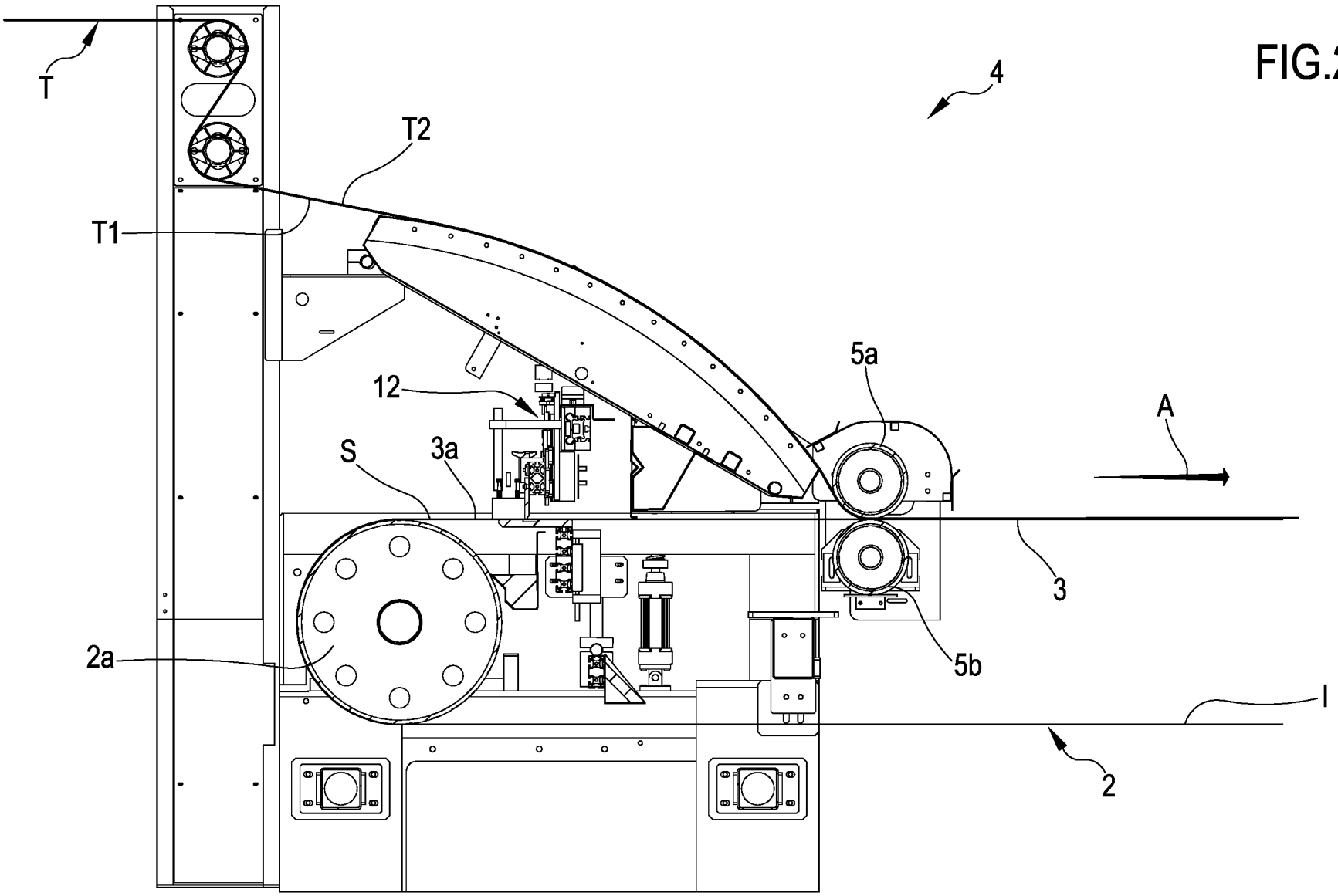
FIG. 2 is a detailed view of a treating station of the plant according to the present invention.

FIG. 2 illustrates a preferred embodiment of the applicator 12 (first example) wherein the applicator 12 is of a fixed type extending transversally to a motion direction of the conveyor belt 2 for all the width of this latter. As an alternative, the plant 1 can comprise a plurality of discrete applicators reciprocally apposed to each other along a direction transversal to the conveyor belt so that said plurality of applicators cover at least partially, particularly all, the width of the conveyor belt 2. Optionally, the plurality of applicators are offset according to plural transversal rows with respect to a motion direction of the conveyor belt.

In a further alternative, the applicator is reciprocally movable transversally to a motion direction of the conveyor belt and is configured for covering a predetermined transversal width of this latter.

Figure 2B:
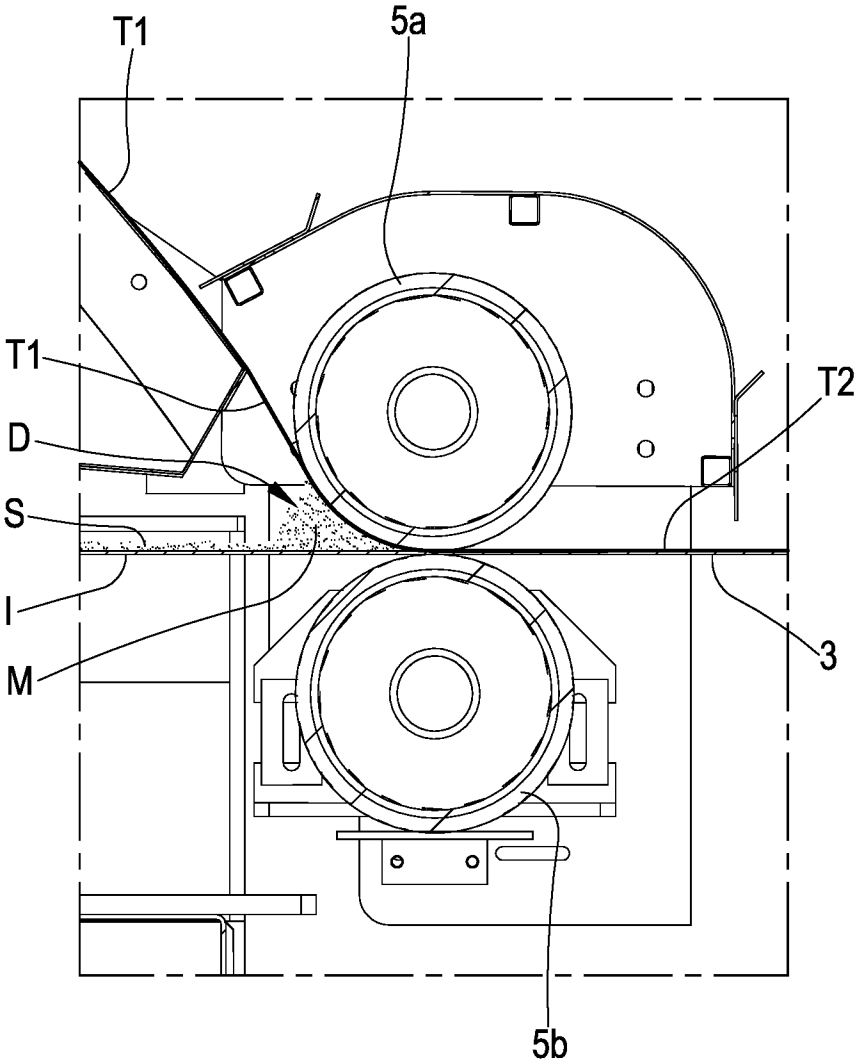
FIG. 2B is a detailed view of the printing plant according to the present invention.
Figure 2A:
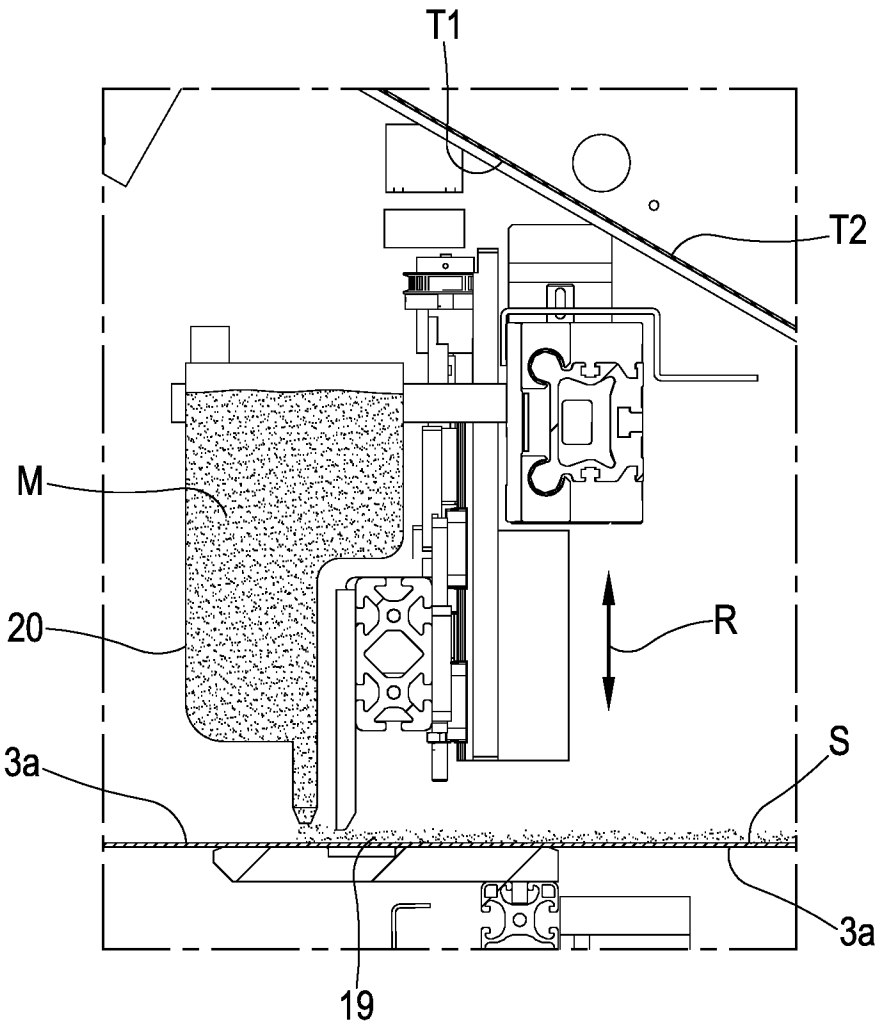
FIG. 2A is a detailed view of the treating station.

In a second example, the applicator 12 of the treating station 4 comprises a coating blade 19 (FIGS. 2A and 4) placed transversally to the motion of the conveyor belt 2, and distanced above the depositing section 3*a*. The coating blade 19 can be associated to a distributor 20 of the treatment composition M, configured for disposing on the depositing section 3*a*, a predetermined quantity of the treatment composition M. The blade 19 is disposed immediately downstream the distributor 20 along the movement direction and is configured for coating on the exposed surface, the treatment composition M supplied by the distributor 20. Advantageously, the coating blade is used, in a non-limiting way, for coating a material M comprising or consisting only of a treatment foam. Advantageously, as illustrated in FIG. 2A, the blade 19 is constrained to the distributor and is movable towards and away from the depositing section. This adjustment of the distance between the blade 3 and conveyor belt 2 (see the adjustment direction R outlined in FIG. 2A) enables to adjust the quantity, particularly, the thickness of the treatment composition M deposited on the belt 2.

Figure 4:
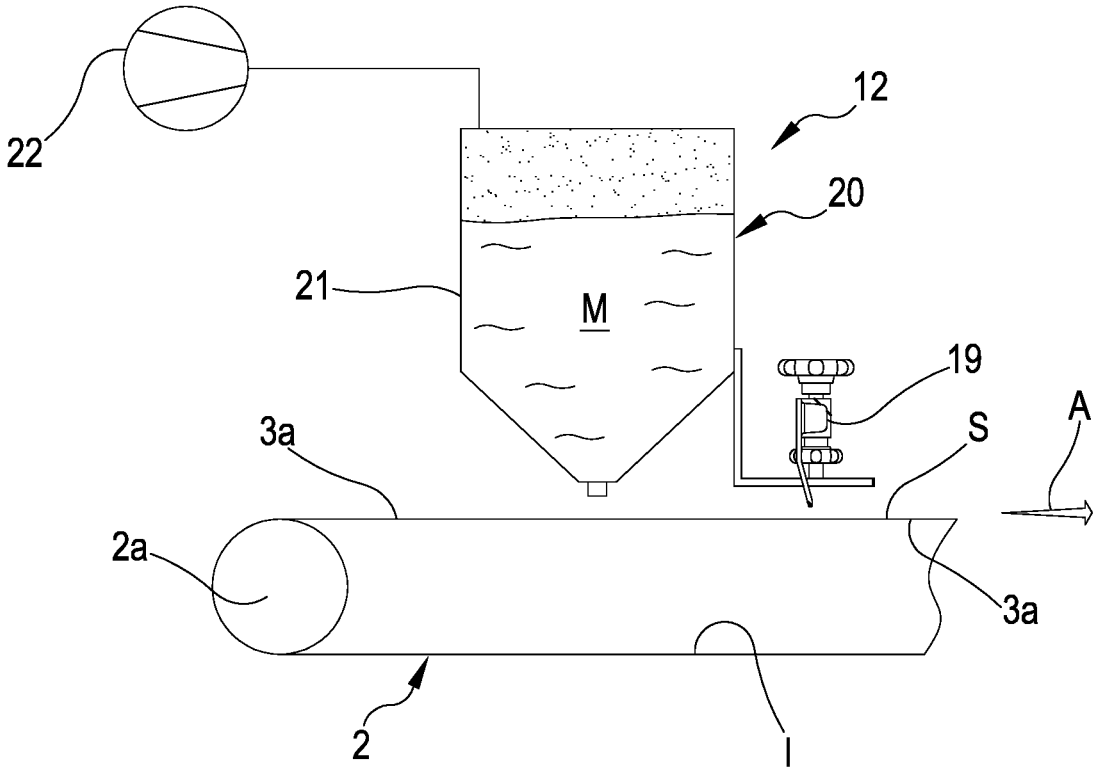

FIG. 4 illustrates a preferred but non-limiting embodiment of the distributor 20 comprising a pressurized reservoir 21 receiving the treatment composition M; the pressurized reservoir 21 is fluidically communicating with a compressor 22 configured for injecting pressurized air into the reservoir 21 in order to enable to supply the treatment composition M. In a preferred arrangement of the invention, the control unit 9 is active on the compressor 22 and is configured for:

- receiving, from a sensor, a signal regarding an operative parameter representative of at least one of: a pressure inside the reservoir 21, a level of the treatment composition M inside the reservoir 21,
- determining, as a function of said signal, the quantity of the composition which is supplied by the reservoir 21,
- comparing the value regarding the quantity of the supplying treatment composition with an optimal value,
- as a function of the comparison, commanding the compressor to control the quantity of the supplying composition from the reservoir 21.

Moreover, the control unit 9 can be connected to an actuator (not illustrated in the attached figures), connected to the blade and configured for moving this latter along the adjustment direction R: the control unit can be configured for commanding the actuator to manage a minimum distance between the blade and the conveyor belt 2.

Moreover, the plant 1 can comprise at least one further sensor, for example a further foam sensor, substantially identical to the above described foam sensor 11. However, the further foam sensor is configured for emitting a control signal representative of the foam quantity placed immediately at an area wherein the treatment composition is supplied by the applicator, particularly immediately upstream the blade of the applicator 12. The control unit is connected to the further foam sensor and is configured for receiving the control signal of the further foam sensor and for determining the quantity of foam placed immediately upstream the blade and particularly at a supplying area of the applicator. The control unit, after detecting the quantity of foam, is configured for controlling the applicator and particularly the distributor 20.

More particularly, the further foam sensor is configured for generating the control signal which exhibits at least one characteristic related to a size of an accumulation of foam in a predetermined control plane immediately upstream the applicator blade; the control unit being configured for:

- receiving said control signal,
- determining, based on said control signal, a measured value of the size of said foam accumulation immediately upstream the blade of the applicator,
- comparing said measured value with at least one reference value or range,
- controlling the supplying of the foam from the applicator based on a difference between said measured value and said reference value or range of said accumulation.

Based on the detected value, the control unit is configured for:

- commanding the applicator to increase a deposition flow rate of said foam on the belt if the measured value of the size of said foam accumulation immediately upstream the blade of the applicator, is less than the reference value or range, and
- commanding said applicator to reduce the deposition flow rate of the foam on the belt if the measured value of the size of said foam accumulation immediately upstream the blade of the applicator, is greater than the reference value or range.

Figure 5:
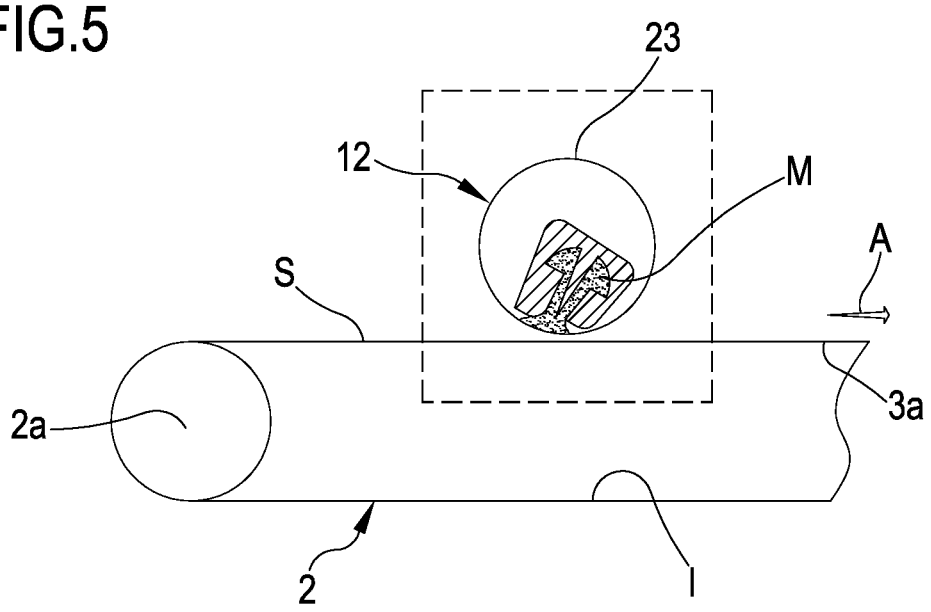
Figure 7:
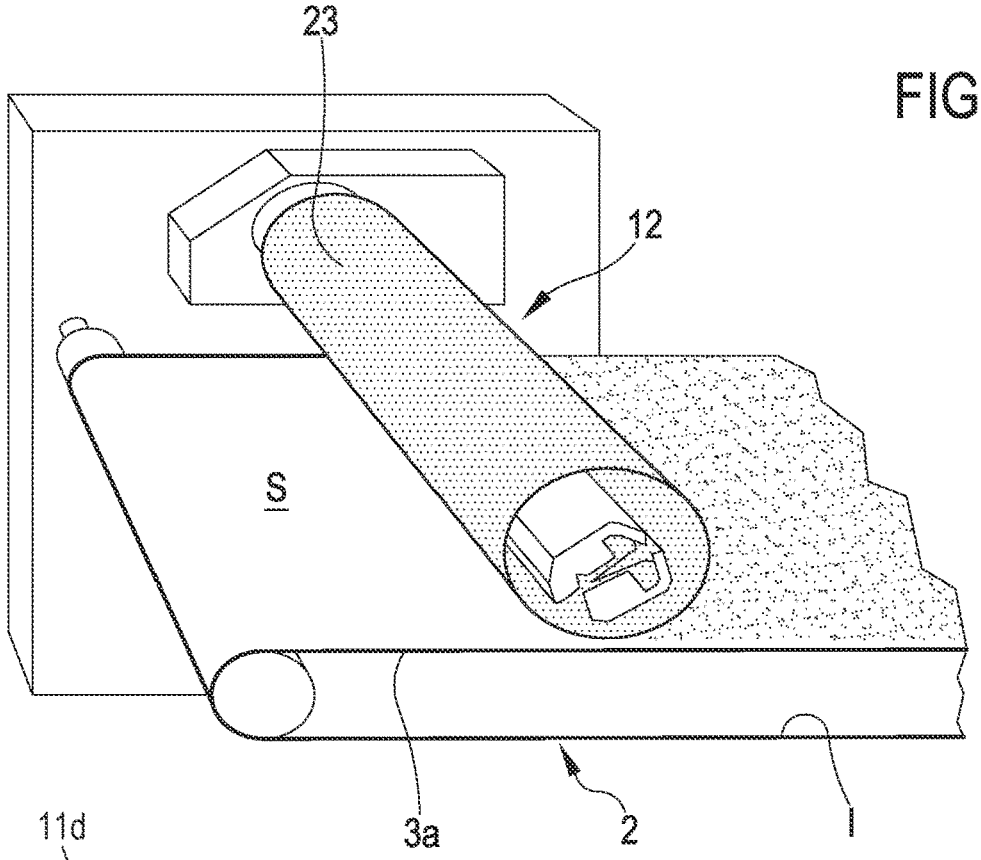

In a third example, the applicator 12 of the treating station 4 comprises a drum 23 (FIG. 5) positioned with the rotation axis transversal to the motion of the conveyor belt 2 and with the lateral surface distanced above the depositing section 3*a* of the conveyor belt 2. The drum 23 exhibits a hollow interior destined to receive a predetermined quantity of the treatment composition M and being provided with a predetermined number of nozzles or slits for supplying the same. Advantageously, the drum can be used in a non-limiting way for applying a composition M comprising or consisting of a treatment foam: in such arrangement, the drum 23 can be supplied by a foamer 13 (FIG. 7) configured for generating a predetermined quantity of foam which is then supplied into the drum 23 which will provide for supplying and coating the foam on the fibrous material T. In a preferred arrangement of the invention, the control unit 9 is active on the foamer 13 and drum 23, and is configured for:

receiving, from the movement sensor engaged with the belt 2, the monitoring signal regarding the movement of the conveyor belt 2, and/or receiving, from the sensor 11, the control signal, as a function of the monitoring signal and/or of the control signal, commanding the foamer 13 to supply a predetermined quantity of foam to the drum 23, as a function of the monitoring signal and/or of the control signal, managing the rotation speed of the drum 23 so that the same can suitably coat the foam on the fibrous material T.

In a fourth example, the applicator 12 of the treating station 4 comprises an applicator roll (this condition is not illustrated in the attached figures) with an associated respective blade for adjusting a thickness of the treatment composition M deposited on a lateral surface of the applicator roll. The applicator roll and blade extend transversally to the conveyor belt 2 and extend substantially along all the width of said belt. The applicator roll is positioned with the rotation axis transversal to the motion of the conveyor belt 2 and with the lateral surface distanced above the section 3*a* of the conveyor belt 2.

Figure 6:
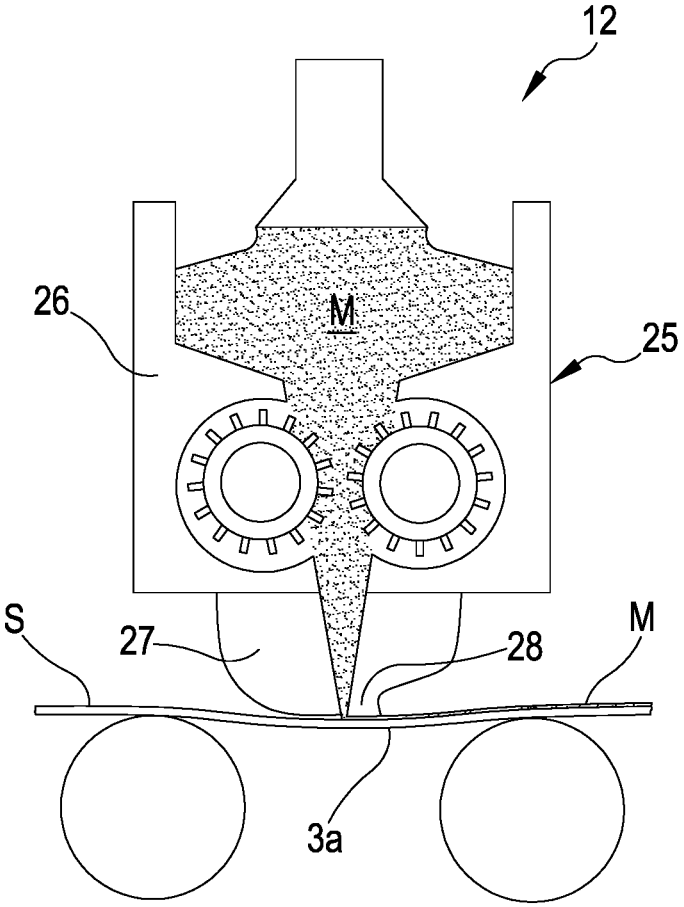

In a fifth example, the applicator 12 of the treating station 4 comprises a distributor 25 comprising a reservoir 26 configured for receiving the treatment composition M (FIG. 6). The reservoir 26 exhibits at least one supplying nozzle 27 placed on and in contact with the depositing section 3*a*: the nozzle 27 extends transversally to the conveyor belt 2 along all the width of this latter. Inside the reservoir 26 there is at least one pusher, for example defined by a toothed wheel, configured for supplying the treatment composition M—for example a treatment liquid or foam—from the nozzle 27. As it is visible in FIG. 6, the nozzle 27 is advantageously provided with a regulator 28 placed immediately downstream the outlet of the treatment composition M, with respect to the movement direction of the operative section of the conveyor belt; the regulator 28 is substantially configured for uniformly coating the composition exiting the nozzle 27 on the section 3*a*.

As hereinbefore described, advantageously the plant 1 can comprise a control unit 9; in such arrangement, the unit 9 can be active on the pusher for managing the quantity of the treatment composition M to be supplied on the conveyor belt 2. More particularly, the control unit 9 is connected to the pusher and is configured for:

receiving, from the movement sensor engaged with the belt 2, the monitoring signal regarding the movement of the conveyor belt 2, receiving from the sensor 11, the control signal, managing, as a function of said control and/or monitoring signals, the pusher (when a toothed wheel manages the rotation speed of the wheel) in order to supply a predetermined quantity of the treatment composition M on the depositing section 3*a*.

The applicator 12 is configured for applying on the exposed surface of the conveyor belt, a treatment foam exhibiting, immediately downstream the applicator 12, a thickness less than 5 mm, particularly comprised between 0.5 and 3 mm.

As it is visible in the attached figures, the plant 1 further comprises a printing station 6 configured for ink-printing, particularly by a digital print, at least part of the second side T2 of the fibrous material T opposite to the first side T1. The printing station 6 operates at the conveyor belt 2 and is configured for printing the fibrous material T (particularly the second side T2) placed on the operative section 3 of the conveyor belt 2. The printing station operates on the conveyor belt 2 immediately downstream the treating station 4. In an embodiment variant, between the treating station 4 and printing station 6, there can be a drying station 16 configured for drying the fibrous material moving along the advancement direction A.

The printing station 6 comprises at least one printing module 7 extending transversally, particularly normal, to the movement direction of the operative section of the conveyor belt 2. In a preferred but non-limiting arrangement of the invention, each printing module 7 exhibits a width, measured normal to the cited movement direction, slightly less (for example 5%-10% less), equal to or greater than the width of the conveyor belt 2. De facto, each printing module 7 is configured for defining a width equal to or greater than the width of the fibrous material T which, during the use, is brought to adhere on the conveyor belt; such width being measured normal to the advancement direction A of the fibrous material T.

Each printing module 7, during the predetermined operative condition of the conveyor belt 2 (the conveyor belt moves continuously so that the fibrous material T continuously moves at a speed greater than 0), is configured for:

defining a print on all a width of the fibrous material T, remaining in a fixed position and printing the second side T2 of the fibrous material T sliding on the operative section 3.

In other words, providing a printing module 7 extending along all the width of the fibrous material T, enables the module itself to remain still—particularly enables to not perform any type of displacements along a longitudinal and/or transversal directions with respect to the movement direction of the operative section of the conveyor belt 2—during the operative condition of the conveyor belt (continuously moving the belt 2) and continuously performing a printing on the fibrous material T by only the movement imparted to the fibrous material T.

More particularly, each printing module 7 comprises a plurality of heads 8 (FIGS. 9 to 11) configured for covering, by the respective nozzles, all the width of the conveyor belt, particularly of the fibrous material T. FIGS. 10 and 11 illustrate an arrangement of the printing module 7 exhibiting at least one first and one second series of heads 8; each series comprises the heads aligned along a prevalent development direction normal to the cited movement direction of the operative section of the conveyor belt 2. The first and second series of heads are adjacent and immediately consecutive to each other along the cited movement direction. As it is visible in the detailed schematic view of FIG. 10, a head 8 of the first row exhibits, with reference to the movement direction, a portion overlapping at least two adjacent heads 8 and immediately consecutive the second row (FIG. 10). Therefore, as it is visible, the nozzles provided on the heads ensure to completely cover the printing width.

In a further embodiment illustrated in FIG. 11, each printing module 7 exhibits a plurality of heads 8 aligned along a prevalent development direction, normal to the cited movement direction, for defining an aligned series of heads; a first head 8 of said aligned series exhibits an end portion which overlaps, with respect the movement direction of the operative section of the conveyor belt 2, an end portion of a second head 8; the first and second heads of said series are adjacent and immediately consecutive to each other along the prevalent development direction of the plurality of heads (see FIG. 11). Also in this case, the nozzles provided on the heads ensure to completely cover the printing width.

As hereinbefore described, in a preferred but non-limiting embodiment of the plant 1, this latter comprises a control unit 9 active on the conveyor belt 2 and connected to a monitoring sensor engaged with said belt 2; moreover, the control unit 9 is connected to the printing station 6 (see the connecting lines c-d-f in FIG. 1, for example) and is configured for:

- receiving, from the monitoring sensor engaged with the belt 2, a signal regarding the movement of the conveyor belt 2,
- managing, as a function of said signal, a movement speed of the conveyor belt 2 and therefore a movement speed of the fibrous material T along the advancement direction A,
- commanding, based on the movement speed of the conveyor belt, the printing station 6 to manage a predetermined quantity of ink to be supplied on the fibrous material T.

Particularly, the control unit 9 is configured for managing the continuous movement of the conveyor belt 2 and, simultaneously, for managing the printing station 6 as a function of the movement speed of the fibrous material T along the advancement direction A.

Therefore, the plant 1, provided with the conveyor belt 2 and printing station 6, can comprise one or more treating stations 4 positioned upstream the printing station 6.

In an embodiment of the plant illustrated in FIG. 1 for example, the same can comprise, in a non-limiting way, a further treating station 10 placed downstream the printing station 6. The further treating station 10 can comprise one or more applicators—according to the applicator 12 of the treating station 4—configured for applying a predetermined quantity of the treatment composition of the second printed side T2 of the fibrous material T. Preferably but in a non-limiting way, the treatment composition supplied by the treating station 4, is different from the treatment composition supplied by the further treating station 10; for example, the treatment composition supplied by the station 4 can substantially comprise an anti-migration agent, while the treatment composition supplied by the station 10 can substantially comprise a pH control agent and a hydrotropic agent.

As it is visible in the attached figure, the plant 1 can comprise a supplying station 14 configured for supplying, particularly directly, the fibrous material to the treating station 4.

The supplying station 14 can comprise a roll of material T placed on a drum, the rotation thereof being commanded by a motor. The fibrous material T is unwound from the drum and supplied to the treating station 4. In a preferred but non-limiting embodiment of the invention, the plant 1 comprises a control unit 9 active on the supplying station 14 (see the line a in FIG. 1) and configured for:

- receiving, from a sensor, a signal regarding the movement of the conveyor belt 2,
- determining, as a function of said signal, a movement speed of the fibrous material T along the advancement direction A,
- as a function of the movement speed of the fibrous material T, commanding a predetermined rotation speed of the drum so that the speed of the conveyor belt 2 is synchronized with the rotation speed of the drum.

In an embodiment variant of the invention, the fibrous material T can be withdrawn from a different supplying station 14 configured for storing as flat layers or bends the fibrous material T (this condition is not illustrated in the attached figures). Moreover, it is not excluded the possibility of directly withdrawing the fibrous material exiting from a further plant for treating the material T such as, for example, a rameuse machine.

As it is visible in the attached figures, moreover the plant 1 can comprise a vaporizer 15 (typically known in the field as "vapor treating devices" or "steam agers") placed downstream the printing station 6 and, if present, downstream the further treating station 10. The vaporizer 15 is configured for drying the fibrous material T provided with print in order to perform a fixing treatment of the printing ink on the material T: the printed material is contained in an environment having a vapor at conditions of pressure and temperature suitable for ensuring to fix the ink to the fibers of the material.

As it is visible in the attached figures, moreover the plant 1 can further comprise at least one drying station 16 positioned downstream the printing station 6 and configured for drying the fibrous material T. FIG. 1 shows an arrangement of the plant 1 wherein the drying station 16 is positioned downstream the conveyor belt 2 with respect to the advancement direction A of the fibrous material T; however, it is not excluded the possibility of providing a drying station at the conveyor belt 2 so that the same can dry the fibrous material placed on the operative section 3 (exiting the printing station 6). In a preferred but non limiting embodiment of the invention, the drying station 16 is placed downstream the vaporizer 15 with reference to the advancement direction of the fibrous material T.

Advantageously, but in a non-limiting way, the plant can comprise a drying station positioned upstream the printing station 6 and particularly positioned between the pressure organ 5*a* and printing station 6. The drying station can comprise, for example, one or more irradiation lamps, particularly infrared lamps. Moreover, the drying station 16 can comprise a blowing system configured for generating an air flow at the sheet fibrous material.

As it is visible in FIG. 1, moreover the plant 1 can comprise a station 17 for gathering the printed fibrous material T. The gathering station 17 is a terminal station placed downstream all the treatment and printing stations provided in the plant 1. As it is for example outlined in FIG. 1, the gathering station 17 is positioned immediately downstream the drying station 16. However, the gathering station can—without the vaporizer 15 and drying station 16—be placed immediately downstream the conveyor belt 2 with reference to the advancement direction A of the fibrous material T.

The gathering station 17 can comprise a drum rotatively commanded by a motor, on which the printed fibrous material is wound.

In a preferred but non-limiting embodiment of the invention, the control unit 9 active on the gathering station 17 (see line m in FIG. 1) is configured for:

- receiving, from a sensor, a signal regarding the movement of the conveyor belt 2,
- determining, as a function of said signal, a movement speed of the fibrous material T along the advancement direction A,
- as a function of the movement speed of the fibrous material T, adjusting the rotation speed of the drum of the gathering station 17 so that as the diameter of the drum or as the speed of the conveyor belt varies, the speed of the fabric exiting the conveyor belt is equal to the peripheral speed of the drum of the gathering station.

In an embodiment variant of the invention, the printed fibrous material T can be accumulated as flat layers or as bends in a different gathering station (this condition is not illustrated in the attached figures).

Moreover, it is not excluded the possibility of directly supplying the printed fibrous material exiting the printing station 6—as an alternative exiting the vaporizer or drying station if present—to a further plant for treating the material T.

Printing Process

Moreover, it is an object of the present invention a process of printing a sheet fibrous material T particularly performed by the plant 1 according to anyone of the attached claims and/or according to the above given description. The process comprises a step of accumulating the fibrous material T, for example from the supplying station 14, and of supplying the same to the treating station 4. Particularly, the process can comprise a step of unwinding the fibrous material T from the drum of the supplying station 14.

The fibrous material is constrained on the exposed surface of the conveyor belt 2 for defining the operative section 3 wherein the belt supports the fibrous material. The first side T1 is brought in contact with the exposed surface of the belt 2. The fibrous material T therefore is moved—by the conveyor belt 2—along an advancement direction A.

Advantageously, but in a non-limiting way, the fibrous material T is constrained (for example by applying an adhesive material) to the exposed surface of the belt 2 so that this latter can stably support said moving material T. The exposed surface S exhibits constantly an operative section 3 of the belt 2, configured for temporarily contactingly receiving the first side T1 of the fibrous material T and guiding such fibrous material along an advancement direction A. In a preferred but non-limiting arrangement of the invention, the conveyor belt 2 continuously moves the fibrous material T along an advancement direction A at a speed constantly greater than 0 (the operative condition of the conveyor belt 2). More particularly, the fibrous material T is continuously moved along the advancement direction A at a speed constantly comprised between 20 and 100 m/min, particularly comprised between 30 and 70 m/min.

The process comprises a step of applying the treatment composition to the first side T1 of the fibrous material T for example by means of one or more applicators 12. Particularly, the step of applying the composition comprises depositing this latter directly on the first side T1 of the sheet fibrous material, since there is no direct deposition of the composition on the second side T2. The step of applying the treatment composition is performed by an applicator 12 acting on the conveyor belt 2 upstream the operative section 3 with respect to the advancement direction of the sheet fibrous material itself.

More particularly, the step of applying the treatment composition comprises at least depositing a predetermined quantity of the treatment composition on the depositing section 3*a* of the conveyor belt 2 by one or more applicators.

More particularly, the process comprises at least the following steps:

generating a predetermined quantity of the treatment composition, supplying the treatment composition to the applicator 12.

The step of applying the treatment composition is performed by one or more of the following steps:

applying by a coating blade placed transversally to the motion of the conveyor belt and distanced above the operative section, applying by a spray dispenser distanced above the operative section, applying by a roll dispenser having an associated respective blade for adjusting the thickness of the treatment composition deposited on the lateral surface of the roll dispenser, this latter being placed with the rotation axis transversal to the motion of the conveyor belt and with the lateral surface distanced above the operative section of the conveyor belt, applying by a drum placed with the rotation axis transversal to the motion of the conveyor belt and with the lateral surface distanced above the operative section of the conveyor belt, the drum exhibiting a hollow interior destined to receive a predetermined quantity of the treatment composition and being provided with a predetermined number of nozzles or slits for supplying the composition, applying by a distributor 25 comprising a reservoir 26 configured for receiving the treatment composition, the reservoir 26 exhibiting at least one supplying nozzle 27 defining an outlet of the reservoir 25, the nozzle 27 extending transversally to the motion of the conveyor belt 2 for all the width of this latter, the distributor 25 comprises one or more pushers, for example one or more toothed wheels, placed inside the reservoir and configured for supplying the treatment composition from the nozzle 27.

Following the step of applying the treatment composition on the depositing section—the conveyor belt 2 moves the treatment composition to an initial contact area wherein the conveyor belt 2 is estimated to start to come in contact with the fibrous material T. As illustrated in FIG. 2B, moving the treatment composition defines an accumulation D of the treatment composition M at the initial contact area.

The process comprises at least one step of bringing in contact the first side T1 of the fibrous material T with the exposed surface of the conveyor belt 2 so that the same can define an operative section 3 wherein the conveyor belt 2 supports the fibrous material. Constraining the fibrous material to the belt is performed by a step of pressing the material itself against the conveyor belt at the initial contact area, for example by one or more pressure organs or rolls or cylinders.

Due to the pressure of the fibrous material on the belt, the process enables the treatment composition—directly and only applied on the first side T1 of the material T—to treat the material and particularly to expand inside the material itself. In this way, the step of contacting (pressuring) the material enables an uniform and correct treatment of the sheet fibrous material.

In a preferred but non-limiting embodiment of the process, the treatment composition comprises a treatment foam. In such arrangement, the process can comprise at least the following steps:

moving the conveyor belt 2, detecting the quantity of the treatment composition, particularly the treatment foam accumulated at the initial contact area, commanding to supply the treatment composition on the depositing section 3*a* as a function of the accumulated foam quantity at the initial contact area. Particularly, the process comprises the following steps:

emitting, particularly by a sensor, a control signal representative of the foam quantity placed immediately upstream the initial contact area, determining, for example by means of a control unit 9, based on said control signal, a measured value of the size of said foam accumulation, comparing, for example by means of the control unit 9, said measured value with at least one reference value or range, controlling, for example by means of the control unit, the applicator based on a difference between said measured value and said reference value or range.

More particularly, the control step comprises at least the following sub-steps:

commanding the applicator to increase a depositing flow rate of said foam on the belt if the measured value of the size of said foam accumulation is less than the reference value or range, and commanding the applicator to reduce the depositing flow rate of the foam on the belt if the measured value of the size of said foam accumulation is greater than the reference value or range.

De facto, by monitoring the accumulation of foam, the process adjusts the supply of the treatment composition in order to deliver the desired foam quantity to the fibrous material.

Besides such control, the process can adjust the supply of the treatment composition—comprising both liquid and/or treatment foam—by monitoring and controlling the movement speed of the conveyor belt. De facto, based on the movement speed of the belt and therefore of the fibrous material along the advancement direction A, the process adjusts the quantity of the composition to be supplied on the depositing section 3*a*.

More particularly, the process can comprise the following steps:

emitting, particularly by means of a monitoring sensor, a signal regarding the motion of the conveyor belt, determining, as a function of said monitoring signal, a movement speed of the fibrous material T along the advancement direction A, as a function of the movement speed of the fibrous material T, commanding to supply the treatment composition, optionally for meeting a desired value of at least one of the following operative parameters:

the composition exhibits, on the depositing section, a thickness less than 5 mm, particularly comprised between 0.5 and 3 mm, the weight percentage per square meter variation of the sheet fibrous material, between a cross-section immediately after the application step, wherein the fibrous material has received the composition, and a cross-section immediately before the step of applying the composition, wherein the fibrous material has not received the foam, is comprised between 10% and 50%, the weight percentage per square meter variation of the sheet fibrous material, between said cross-section immediately before the step of applying the treatment composition and said cross-section immediately before the printing step, is comprised between 10% and 50%.

Controlling the quantity of the treatment composition can be performed by considering at least one of the following parameters: accumulation of the treatment composition at the initial contact area, the speed of the moving belt 2.

After the step of contacting the fibrous material with the belt, the second side T2 of the material T itself—opposite to the first side T1—is ink-printed, optionally by a digital print. De facto, the second side T2 of the treated fibrous material exiting the treating station and in contact with the belt 2 is printed. The printing step is performed on the second side T2 of the fibrous material placed on the operative section 3.

As hereinbefore described, the printing station 6 comprises at least one printing module 7 which, during the movement of the fibrous material T (operative condition of the conveyor belt 2), remains in a fixed position and prints on all a width of the fibrous material T. Plural printing modules 7 can be provided (for example from 3 to 10) parallelly positioned to each other astride the conveyor belt and consecutively placed along the advancement direction A: for example the printing heads of each module can be supplied by a respective ink in order to obtain any chromatic combination.

The step of moving the fibrous material T is preferably but in a non-limiting way performed continuously at a speed constantly greater than 0, particularly constantly comprised between 20 and 100 m/min, still more particularly comprised between 30 and 70 m/min. The steps of applying the treatment composition and printing are performed in-line during the continuous movement of the fibrous material T.

Moreover, the process can comprise, after the printing step, a further treatment step, for example performed by the station 10, during which the treatment composition is applied on the second side T2 of the printed material T.

Moreover, the process can comprise one or more steps of drying the sheet fibrous material, for example by means of the station 16; particularly, the process can comprise a step of drying the fibrous material immediately exiting the pressure organ 5*a*: such drying step enables to dry the treated fibrous material before the printing step. Moreover, the process can comprise a second drying step performed after the printing step: the printed material exiting the station 6 is caused to pass through the drying station 16.

The process, according to the present invention, can further comprise a step of supplying the fibrous material T by means of the station 14. The supplying step enables to directly supply the fibrous material T towards the treating station 4.

The supplying step can be performed by unwinding a roll of the material T placed on a drum rotatively commanded by a motor. In a preferred but non-limiting embodiment of the invention, the process comprises the following steps:

receiving, from a sensor, a signal regarding the movement of the conveyor belt 2, determining, as a function of said signal, a movement speed of the fibrous material T along the advancement direction A, as a function of the movement speed of the fibrous material T, commanding a predetermined rotation speed of the drum so that the speed of the conveyor belt 2 is synchronized with the rotation speed of the drum.

Moreover, the process can comprise a vaporizing step—by the means of the vaporizer 15—performed after the step of printing the sheet fibrous material. The vaporizing step enables to perform a fixing treatment of the printing ink on the material T: the printed material is contained in an environment having a vapor at conditions of pressure and temperature suitable for ensuring to fix the ink to the fibers of the material.

Moreover, the process can comprise a step of drying the printed fibrous material. The drying step can be performed on the material exiting the belt 2 or on the material placed on the operative section of the conveyor belt 2. In a preferred but non-limiting embodiment of the invention, the drying step is performed immediately after the vaporizing step.

Moreover, the process comprises a step of gathering the printed material for example by the gathering station 17. The gathering step enables to bring together the printed material exiting the conveyor belt 2 for example around a gathering drum, for defining a roll of printed material, or as an alternative in a container for gathering the printed material as layers.

The invention claimed is:

1. A digital fabric printing system comprising:

a fabric supply station configured to supply a fabric to be printed along a predetermined operative path;

a treating station configured to treat the supplied fabric with a treatment composition by depositing the composition to the fabric at a first side of the fabric as a foam and then pressing the composition into the fabric such that the treatment composition is forced into the fabric from the first side; and a printing station disposed downstream of the treating station and configured to digitally ink-print at least part of a second side of the treated fabric opposite to the first side.

2. The printing system of claim 1, wherein the treating station comprises at least one treatment composition applicator operating below the fabric supplied along said operative path.

3. The printing system of claim 1, wherein the treating station is configured to deposit the treatment composition directly to and only at the first side of the fabric.

4. The printing system of claim 1, wherein the printing station is a single pass printer with printing heads fixed during printing.

5. The printing system of claim 1, comprising a conveyor belt with an exposed surface configured to receive the fabric from the supplying station and to guide the received fabric along an advancement direction, and to carry the received fabric through the printing station.

6. The printing system of claim 5, further comprising a foam sensor configured to emit a control signal representative of a quantity of the foam applied by the treating station.

7. The printing system of claim 6, wherein the foam sensor is positioned to detect foam quantity present immediately upstream of initial contact between the fabric and the conveyor belt, such that said control signal is representative of a foam quantity present immediately upstream of the initial contact between the first side of the fabric and the exposed surface of the conveyor belt.

8. The printing system of claim 5, wherein the exposed surface of the conveyor belt is configured to directly receive the treatment composition at the treating station upstream of receiving the fabric from the supplying station.

9. The printing system of claim 8, wherein said treating station is configured to apply on the exposed surface of the conveyor belt foam exhibiting an initial thickness of between 0.5 and 3 mm.

10. The printing system of claim 5, wherein the printing station comprises at least one printing module extending across the conveyor belt and defining a printing width, measured normal to the advancement direction, at least equal to 80% of an overall width of the conveyor belt.

11. The printing system of claim 10, wherein each printing module comprises a plurality of staggered heads arranged to cover said printing width.

12. The printing system of claim 5, comprising a controller configured to command a continuous movement of the conveyor belt during simultaneous printing operation of the printing station.

13. The printing system of claim 5, wherein the treating station comprises a foam applicator including at least one of the group consisting of:

a coating blade extending transverse to the motion of the conveyor belt and movable with respect to the exposed belt surface, a spray dispenser movable with respect to the belt surface, an applicator roll with an associated respective blade for adjusting a thickness of the treatment foam deposited on a lateral surface of the applicator roll, the applicator roll having a rotation axis extending across the conveyor belt and movable with respect to the belt surface, a drum having a rotation axis extending across the conveyor belt and movable with respect to the belt surface, the drum defining a hollow interior configured to contain a quantity of a treatment foam and having a number of nozzles or slits for supplying the foam, and a foam distributor comprising a reservoir configured to receive the treatment foam, the reservoir having at least one supplying nozzle defining an outlet of the reservoir and extending across the conveyor belt, the distributor containing one or more toothed wheels configured to push the treatment foam from the nozzle.

14. The printing system of claim 13, comprising a controller configured to:

control continuous movement of the conveyor belt, receive a desired value of an operative parameter representative of a quantity of treatment composition to be applied on the fabric, said operative parameter comprising at least one of the group consisting of:

a difference in weight per area of the fabric immediately upstream of the treating station and immediately downstream of the treating station, a difference in weight per area of the fabric immediately upstream of the treating station and immediately upstream of the printing station, a volume flow rate of the treatment composition being applied at the treating station, a mass flow rate of the treatment composition being applied at the treating station, and a thickness of the composition following application, and to command the treating station to manage application of the treatment composition as a function of the desired value of the operative parameter and of the movement of said conveyor belt.

15. The printing system of claim 5, wherein the conveyor belt is configured to move at a constant speed of between 20 and 100 m/min during printing.

16. A digital fabric printing system comprising:

a supply station configured to supply a fibrous material to be printed along a predetermined operative path;

a treating station configured to treat the fibrous material with a treatment composition by depositing the composition to the fibrous material at a first side of the fibrous material as a foam;

a printing station configured to digitally ink-print at least part of a second side of the fibrous material opposite to the first side;

a conveyor belt with an exposed surface configured to receive the fibrous material from the supplying station and to guide the received fibrous material along an advancement direction, and to carry the received fibrous material through the printing station; and a foam sensor configured to emit a control signal responsive to an accumulation of foam caused by an initial contact between the treated fibrous material and the conveyor belt.

17. The printing system of claim 16, wherein the treating station is configured to deposit the treatment composition directly to and only at the first side of the fibrous material.

18. The printing system of claim 16, wherein the printing station is a single pass printer with printing heads fixed during printing.

19. The printing system of claim 16, comprising a controller configured to:

control continuous movement of the conveyor belt, receive a desired value of an operative parameter representative of a quantity of treatment composition to be applied on the fibrous material, and to command the treating station to manage application of the treatment composition as a function of the desired value of the operative parameter and of the movement of said conveyor belt.

20. The printing system of claim 16, wherein said control signal is representative of the accumulation of foam between the first side of the fibrous material and the exposed surface of the conveyor belt.

* * * * *